US008567917B2

(12) United States Patent
Hiramoto

(10) Patent No.: US 8,567,917 B2
(45) Date of Patent: Oct. 29, 2013

(54) METHOD OF STIRRING LIQUID IN DROPLET DISCHARGE HEAD AND DROPLET DISCHARGE APPARATUS

(75) Inventor: Goki Hiramoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 715 days.

(21) Appl. No.: 12/627,995

(22) Filed: Nov. 30, 2009

(65) Prior Publication Data

US 2010/0171796 A1 Jul. 8, 2010

(30) Foreign Application Priority Data

Dec. 17, 2008 (JP) ..... 2008-320499

(51) Int. Cl.
*B41J 2/045* (2006.01)
*B41J 2/175* (2006.01)

(52) U.S. Cl.
USPC ..... 347/68; 347/85

(58) Field of Classification Search
CPC ..... B41J 2/175; B41J 29/38
USPC ..... 347/72
See application file for complete search history.

(56) References Cited

U.S. PATENT DOCUMENTS

| | | | | |
|---|---|---|---|---|
| 4,364,067 | A * | 12/1982 | Koto et al. | 347/70 |
| 4,769,654 | A * | 9/1988 | Tanaka et al. | 347/40 |
| 6,488,354 | B2 * | 12/2002 | Hosono | 347/23 |
| 7,032,990 | B2 | 4/2006 | Takano et al. | |
| 7,478,898 | B2 * | 1/2009 | Yamada et al. | 347/68 |
| 7,503,640 | B2 * | 3/2009 | Sugahara et al. | 347/40 |
| 2009/0231372 | A1 * | 9/2009 | Shibata | 347/11 |

FOREIGN PATENT DOCUMENTS

| | | | |
|---|---|---|---|
| JP | 2000-085125 | A | 3/2000 |
| JP | 2001-270134 | A | 10/2001 |
| JP | 2004-130299 | A | 4/2004 |
| JP | 2006-035568 | A | 2/2006 |
| JP | 2008-229890 | A | 10/2008 |

* cited by examiner

*Primary Examiner* — Lisa M Solomon
(74) *Attorney, Agent, or Firm* — Global IP Counselors, LLP

(57) ABSTRACT

In a method of stirring liquid in a droplet discharge head in which droplets of the liquid are discharged from a plurality of nozzle openings by driving piezoelectric elements provided to each of the nozzle openings, drive conditions of the piezoelectric elements are varied and the liquid that corresponds to the piezoelectric elements is caused to flow at different pressures.

10 Claims, 17 Drawing Sheets

METHOD OF STIRRING LIQUID IN DROPLET DISCHARGE HEAD AND DROPLET DISCHARGE APPARATUS

CROSS-REFERENCE TO RELATED APPLICATIONS

The entire disclosure of Japanese Patent Application No. 2008-320499, filed Dec. 17, 2008 is expressly incorporated by reference herein.

BACKGROUND

1. Technical Field

The present invention relates to a method of stirring liquid in a droplet discharge head and to a droplet discharge apparatus.

2. Related Art

In a droplet discharge head used in a droplet discharge printer, a blotter, or another recording apparatus, there is a possibility that water or another ink solvent will evaporate in the nozzle opening, and the ink viscosity will increase to be greater than necessary. An increase in the ink viscosity that is greater than necessary leads to defects such as decreasing of the size (weight) of the ink drops (droplets).

Particularly in cases in which a liquid that could possibly precipitate is used, such as a nonaqueous solvent-based ink that uses a pigment for the coloring material, a dispersion-based ink, or a UV curing ink, reducing the size of the nozzle opening or occasionally blocking off the nozzle opening are considered as options.

In view of this, Japanese Laid-open Patent Application Nos. 2000-085125 and 2001-270134 disclose techniques in which microvibration that is insufficient for ink discharge is induced in the meniscus in the nozzle opening, whereby the ink in the nozzle opening is stirred and the ink viscosity is maintained.

However, the conventional techniques described above have the following problems.

Since the aforementioned ink stirring is performed at a pressure in a range at which the ink is not discharged, it has been difficult to classify the stirring as being sufficient.

Particularly in cases in which one of the aforementioned precipitation-capable liquids is used, precipitation could possibly occur not only in the nozzle opening but also in the ink channel for feeding the ink to the nozzle, but it is extremely difficult with the microvibration to stir the ink in the ink channel, which is in a position separated from the nozzle opening.

SUMMARY

The present invention was devised in view of the issues described above, and an object thereof is to provide a method of stirring liquid in a droplet discharge head, and a droplet discharge apparatus in which a liquid can be effectively stirred in the liquid flow channels in the head interior as well.

In order to achieve the object described above, the present invention is configured as described below.

The method of stirring liquid in a droplet discharge head according to the present invention is a method of stirring liquid in a droplet discharge head wherein droplets of the liquid are discharged from a plurality of nozzle openings by driving piezoelectric elements provided to each of the nozzle openings. The method includes a step of causing the liquid corresponding to the piezoelectric elements to flow at different pressures by varying drive conditions of the piezoelectric elements.

Consequently, in the method of stirring liquid in a droplet discharge head according to the present invention, the drive states of the piezoelectric elements differ, and different pressures are therefore applied to the liquid in the flow channels that correspond to each nozzle opening in the head. Therefore, in the present invention, the liquid in the flow channels that correspond to the nozzle openings is caused to flow by the pressure generated by the driving of the piezoelectric elements that correspond to the flow channels, and is also caused to flow by the pressure difference relative to the liquid in the flow channels that correspond to other nozzle openings.

Therefore, in the present invention, efficient stirring can be achieved even in cases in which the piezoelectric elements are driven with force insufficient to discharge droplets from the nozzle openings. This is because the liquid in the flow channels is caused to flow by the aforementioned pressure difference.

In cases in which the droplet discharge head is configured with a plurality of flow channels that feeds the liquid to the nozzle openings, the flow channels being respectively provided to the nozzle openings, and also with a liquid reservoir that retains the liquid, the liquid reservoir being connected to each of the flow channels, it is preferable to use a configuration in which the piezoelectric elements are driven in mutually opposite directions in flow channels that are adjacent to each other via the liquid reservoir.

Thus, in the present invention, when positive pressure is applied, for example, to the liquid in a first flow channel, the liquid flows toward the liquid reservoir, and negative pressure is applied to the liquid in an adjacent second flow channel, causing the liquid to flow in from the liquid reservoir, thereby creating a flow of liquid throughout the liquid reservoir. Therefore, efficient stifling can be achieved because the liquid in the first flow channel is subjected to pressure that induces a flow toward the second flow channel via the liquid reservoir, and the length of the flow increases.

For the plurality of flow channels, a configuration can be suitably used in which the flow channels are aligned in a plural number along the direction of extension of the liquid reservoir on one side of the liquid reservoir, or a configuration in which the flow channels are disposed on both sides of the liquid reservoir.

In the present invention, a configuration can be suitably used in which the piezoelectric elements corresponding to flow channels that are adjacent to each other via the liquid reservoir are synchronously driven in mutually opposite phases.

It is thereby made possible in the present invention to maximize the pressure difference in the liquid caused by oppositely directed driving, and to cause the liquid to flow over greater distances and achieve more-effective stirring.

In a configuration in which the droplet discharge head has a plurality of flow channels that feeds the liquid to the nozzle openings, the flow channels being provided to each of the nozzle openings, and also has a liquid reservoir that retains the liquid, the liquid reservoir being connected to each of the flow channels, an arrangement can be suitably used in which a plurality of flow channel groups having the flow channels is provided, and the piezoelectric elements in each flow channel group are driven in the same direction while the piezoelectric elements in flow channel groups that are adjacent to each other via the liquid reservoir are driven in mutually opposite directions.

Thus, in the present invention, when positive pressure is applied, for example, to the liquid in a first flow channel group, the liquid from the plurality of flow channels flows toward the liquid reservoir, and negative pressure is applied to the liquid in an adjacent second flow channel group, causing the liquid to flow from the liquid reservoir into the plurality of flow channels, thereby creating a flow of liquid throughout the liquid reservoir. Therefore, efficient stirring can be achieved because the liquid in the first flow channel group is subjected to a large amount of pressure that induces a flow toward the second flow channel via the liquid reservoir, and the length of the flow increases. The liquid in the liquid reservoir can also be efficiently stirred.

In the configuration described above, an arrangement can be suitably used in which the piezoelectric elements corresponding to flow channel groups that are adjacent to each other via the liquid reservoir are synchronously driven in mutually opposite phases.

Thus, in the present invention, the difference in liquid pressure between flow channel groups being driven in opposite directions can be maximized, and the liquid can be caused to flow over greater distances, making stirring more effective.

In the present invention, a procedure can be suitably used in which the piezoelectric elements are driven in a state in which the nozzle openings are closed off.

In the present invention, the nozzle openings are closed off and droplets of liquid are not discharged from the nozzle openings even when the piezoelectric elements are strongly driven, and the piezoelectric elements can therefore be driven with greater force (vibration) rather than with microvibration that is insufficient for droplets to be discharged from the nozzle openings. Therefore, in the present invention, the liquid in a droplet discharge head pressurized by the driving of the piezoelectric elements flows between the nozzle openings and the liquid supply side (in the direction opposite to the side facing the nozzle openings) over much greater distances than when the liquid is caused to flow by microvibration according to the prior art because the nozzle openings are closed off, and more-effective stirring can be achieved.

The droplet discharge apparatus of the present invention is a droplet discharge apparatus including a droplet discharge head for discharging droplets of a liquid from a plurality of nozzle openings by the driving of piezoelectric elements provided to each of the nozzle openings, the apparatus includes a drive control device that varies drive conditions of the piezoelectric elements to cause the liquid that corresponds to the piezoelectric elements to flow at different pressures.

Consequently, in the droplet discharge apparatus of the present invention, the drive states of the piezoelectric elements differ, and different pressures are therefore applied to the liquid in the flow channels that correspond to each nozzle opening in the head. Therefore, in the present invention, the liquid in the flow channels that correspond to the nozzle openings is caused to flow by the pressure generated by the driving of the piezoelectric elements that correspond to the flow channels, and is also caused to flow by the pressure difference relative to the liquid in the flow channels that correspond to other nozzle openings.

Therefore, in the present invention, efficient stirring can be achieved even in cases in which the piezoelectric elements are driven with force insufficient to discharge droplets from the nozzle openings. This is because the liquid in the flow channels is caused to flow by the aforementioned pressure difference.

A configuration can be suitably used in which the droplet discharge head has a plurality of flow channels that feeds the liquid to the nozzle openings, the flow channels being respectively provided to the nozzle openings, and also has a liquid reservoir that retains the liquid, the liquid reservoir being connected to each of the flow channels; wherein the drive control device drives the piezoelectric elements in mutually opposite directions in the flow channels that are adjacent to each other via the liquid reservoir.

Thus, in the present invention, when positive pressure is applied, for example, to the liquid in a first flow channel, the liquid flows toward the liquid reservoir, and negative pressure is applied to the liquid in an adjacent second flow channel, causing the liquid to flow in from the liquid reservoir, thereby creating a flow of liquid throughout the liquid reservoir. Therefore, efficient stirring can be achieved because the liquid in the first flow channel is subjected to pressure that induces a flow toward the second flow channel via the liquid reservoir, and the length of the flow increases.

For the plurality of flow channels, a configuration can be suitably used in which the flow channels are aligned in a plural number along the direction of extension of the liquid reservoir on one side of the liquid reservoir, or a configuration in which the flow channels are disposed on both sides of the liquid reservoir.

In the present invention, a configuration can be suitably used in which the piezoelectric elements corresponding to flow channels that are adjacent to each other via the liquid reservoir are synchronously driven in mutually opposite phases.

It is thereby made possible in the present invention to maximize the pressure difference in the liquid caused by oppositely directed driving, and to cause the liquid to flow over greater distances and achieve more-effective stirring.

A configuration can be suitably used in which the droplet discharge head has a plurality of flow channels for feeding the liquid to the nozzle openings, the flow channels being respectively provided to of the nozzle openings, and also has a liquid reservoir for retaining the liquid, the liquid reservoir being connected to each of the flow channels; wherein the drive control device drives the piezoelectric elements in a flow channel group in the same direction among a plurality of flow channel groups formed by the flow channels, and the piezoelectric elements in flow channel groups that are adjacent to each other via the liquid reservoir are driven in mutually opposite directions.

Thus, in the present invention, when positive pressure is applied, for example, to the liquid in a first flow channel group, the liquid from the plurality of flow channels flows toward the liquid reservoir, and negative pressure is applied to the liquid in an adjacent second flow channel group, causing the liquid to flow from the liquid reservoir into the plurality of flow channels, thereby creating a flow of liquid throughout the liquid reservoir. Therefore, efficient stirring can be achieved because the liquid in the first flow channel group is subjected to a large amount of pressure that induces a flow toward the second flow channel via the liquid reservoir, and the length of the flow increases. The liquid in the liquid reservoir can also be efficiently stirred.

In the configuration described above, an arrangement can be suitably used in which the piezoelectric elements corresponding to flow channel groups that are adjacent to each other via the liquid reservoir are synchronously driven in mutually opposite phases.

Thus, in the present invention, the difference in liquid pressure between flow channel groups being driven in opposite directions can be maximized, and the liquid can be caused to flow over greater distances, making stirring more effective.

In the present invention, a configuration can be suitably used which has an opening and closing device that opens and closes the nozzle openings, wherein the drive control device drives the piezoelectric elements in a state in which the nozzle openings are closed off.

In the present invention, the nozzle openings are closed off and droplets of liquid are not discharged from the nozzle openings even when the piezoelectric elements are strongly driven, and the piezoelectric elements can therefore be driven with greater force (vibration) rather than with microvibration that is insufficient for droplets to be discharged from the nozzle openings. In the present invention, therefore, the liquid in a droplet discharge head pressurized by the driving of the piezoelectric elements flows between the nozzle openings and the liquid supply side (in the direction opposite to the side facing the nozzle openings) over much greater distances than when the liquid is caused to flow by microvibration according to the prior art because the nozzle openings are closed off, and more-effective stirring can be achieved.

DETAILED DESCRIPTION OF EXEMPLARY EMBODIMENTS

Figure 1:
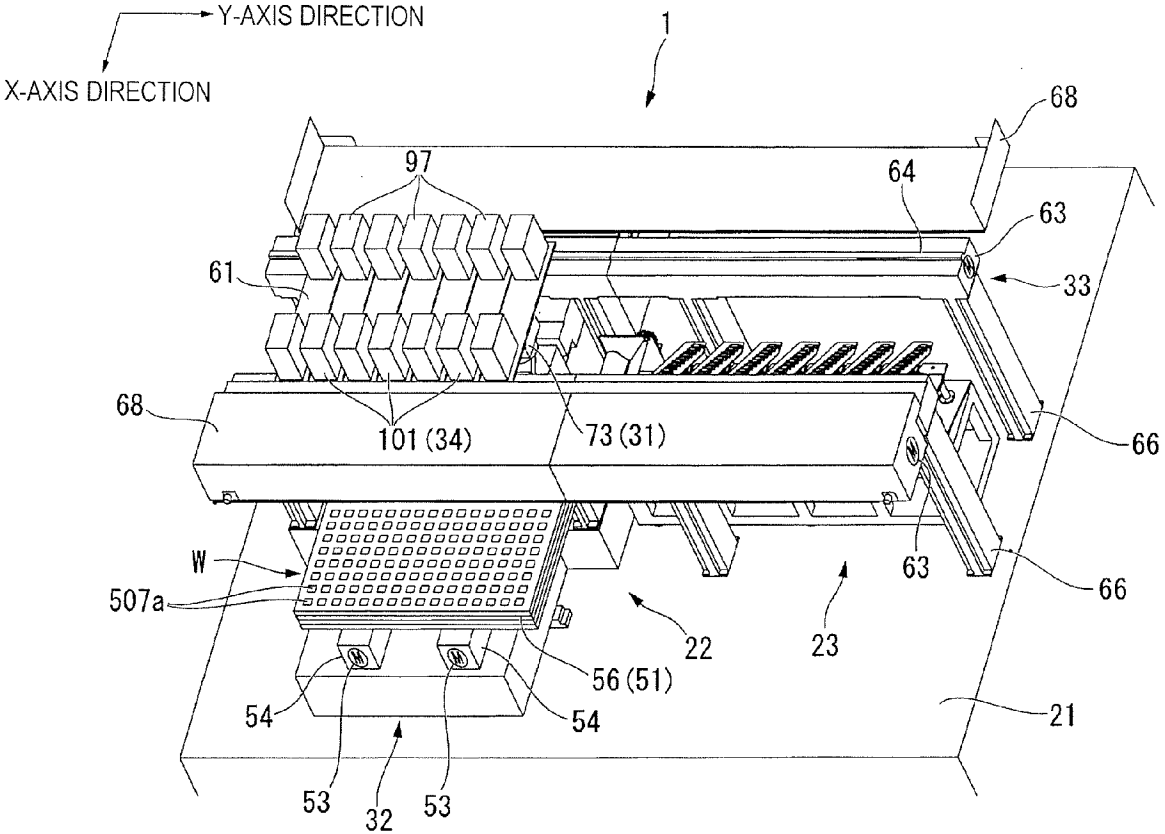
FIG. 1 is an external perspective view of a droplet discharge apparatus.

The following is a description, made with reference to FIGS. 1 through 17, of embodiments of the method of stirring liquid in a droplet discharge head, and a droplet discharge apparatus according to the present invention.

In the drawings used in the following description, the components are appropriately varied in scale in order to depict the components in an easily identifiable size.

First, the droplet discharge apparatus will be described.

Figure 2:
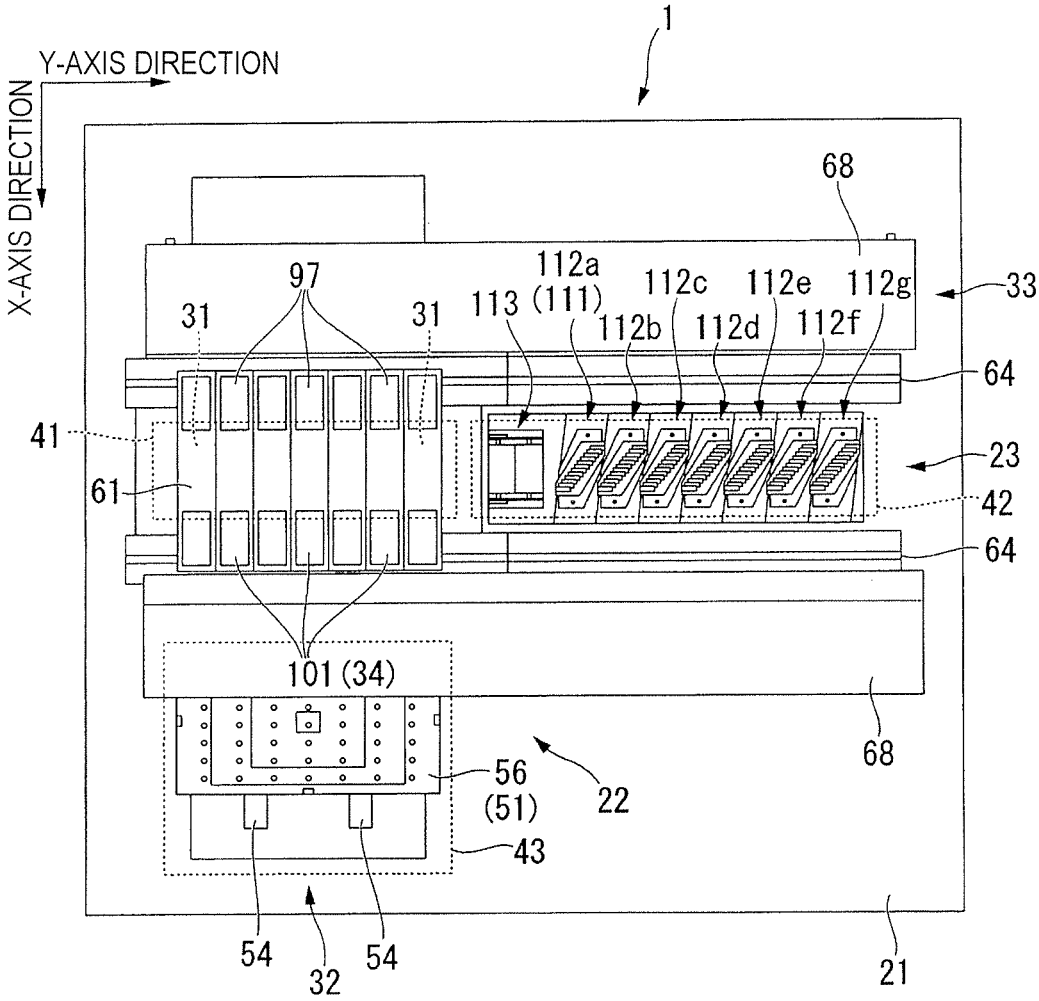
FIG. 2 is a plan view of a droplet discharge apparatus.
Figure 3:
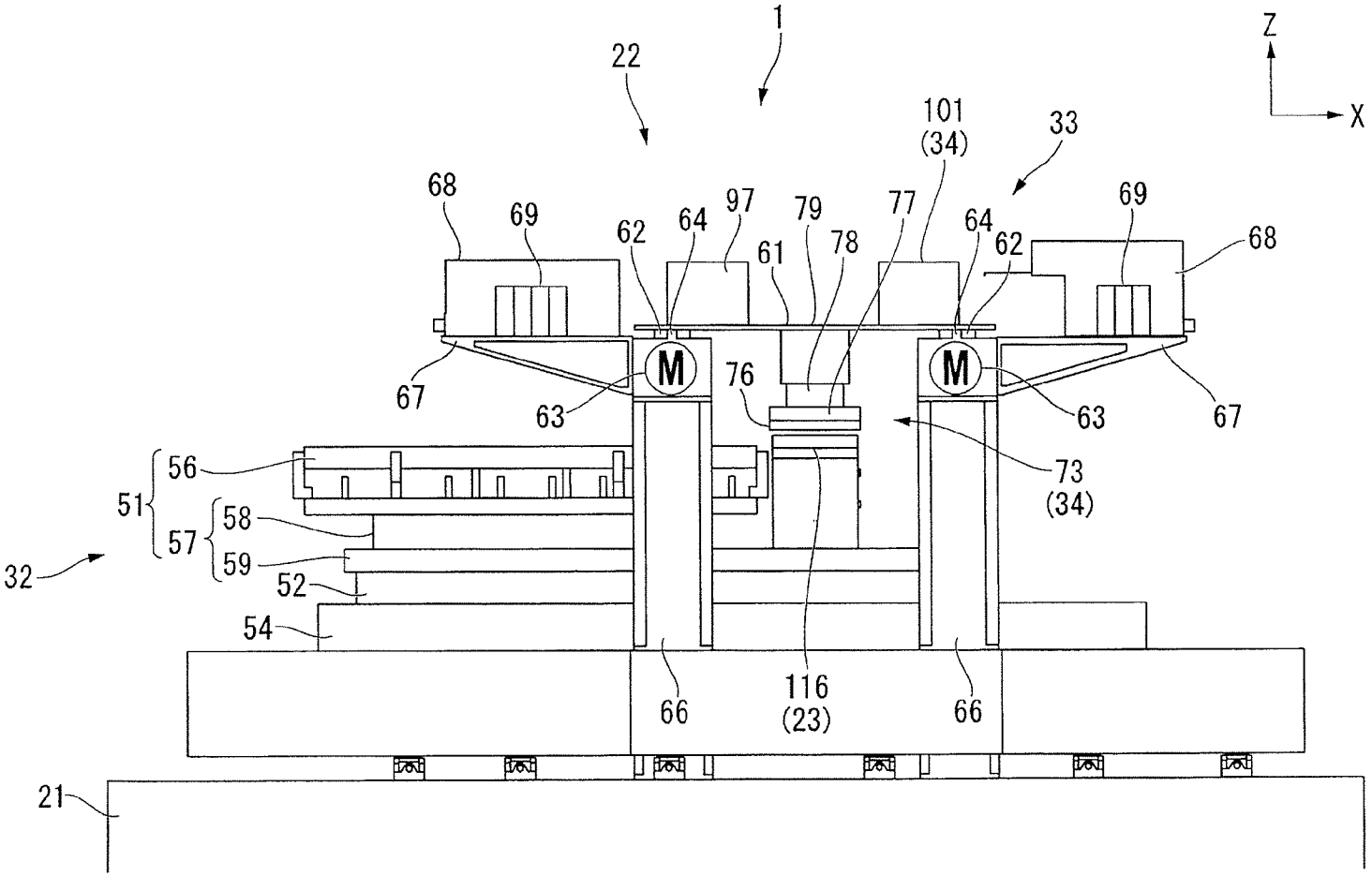
FIG. 3 is a side view of a droplet discharge apparatus.

A droplet discharge apparatus 1 comprises a large common stand 21 set up on the floor, a drawing device 22 placed over the entire common stand 21, and maintenance means 23 provided to the drawing device 22 as shown in FIGS. 1 through 3, wherein functional maintenance and restoration of functional liquid droplet discharge heads 72 (droplet discharge heads; see FIGS. 4 through 6) are performed by the maintenance means 23, and a drawing process for discharging a functional liquid onto a workpiece W is performed by the drawing device 22. Furthermore, a controller 24 (control unit 132, see FIG. 8) or the like connected to a high-level computer 3 and used for controlling the various means of the droplet discharge apparatus 1 is incorporated into the droplet discharge apparatus 1.

The workpiece W (see FIG. 1) introduced into the droplet discharge apparatus 1 is a transparent substrate configured from quartz glass, a polyimide resin, or the like, for example.

First, the drawing device 22 in the droplet discharge apparatus 1 and the drawing process performed by this device will be described. The drawing device 22 comprises a plurality of (i.e., seven) carriage units 31 composed of a plurality of (i.e., twelve) functional liquid droplet discharge heads 72 and a carriage 73 on which they are mounted; an X-axis table 32 for moving the workpiece W in the X-axis direction, the X-axis table being set up on the common stand 21 and provided with a positioning table 51 on which the workpiece W is positioned; a Y-axis table 33 for moving the seven carriage units 31 individually in the Y-axis direction, the Y-axis table being placed so as to cross over the X-axis table 32; functional liquid supply means 34 composed of seven functional liquid supply units 101 for supplying functional liquid respectively to the functional liquid droplet discharge heads 72 mounted on the seven carriage units 31; and image recognition means 35 (see FIG. 8) for recognizing the image of the workpiece W, the carriage units 31, and other components.

The area where the movement path of the workpiece W via the X-axis table 32 and the movement path of the carriage units 31 by the Y-axis table 33 intersect constitutes a drawing area 41 where the drawing process is performed, and the area outside of the X-axis table 32 in the movement path of the carriage units 31 via the Y-axis table 33 constitutes a drawing standby area 42, wherein the aforementioned maintenance means 23 is set up in the drawing standby area 42. The area at the front of the X-axis table 32 constitutes a workpiece-conveying area 43 for conveying the workpiece Win and out of the droplet discharge apparatus 1.

The X-axis table 32 comprises the positioning table 51 on which the workpiece W is positioned after being transported to the table, an X-axis air slider 52 for supporting the positioning table 51 in a manner that allows the table to slide in the X-axis direction, a pair of left and right X-axis linear motors 53, 53 which extend in the X-axis direction and move the workpiece W in the X-axis direction via the positioning table 51, a pair of X-axis guide rails 54, 54 which are provided in parallel with the X-axis linear motors 53 and which guide the movement of the X-axis air slider 52, and an X-axis linear scale (not shown) for monitoring the position of the positioning table 51. When the pair of X-axis linear motors 53, 53 is driven, the X-axis air slider 52 is moved in the X-axis direction while the pair of X-axis guide rails 54, 54 acts as guides, and the workpiece W positioned on the positioning table 51 moves in the X-axis direction.

The positioning table 51 has a suction table 56 on which the workpiece W is directly positioned by suction; a rotating part 58 connected to the bottom of the suction table 56; and a workpiece θ-axis table 57 for finely adjusting (correcting for θ) the θ position of the workpiece W via the suction table 56, the workpiece θ-axis table being connected to the bottom of the rotating part 58 and configured from a stationary part 59 placed on the X-axis air slider 52.

The suction table 56 has a substantially square shape in a plan view, the length of one side thereof being designed in accordance with the length of the long side of a maximum sized workpiece W to allow the workpiece W to be positioned as desired in either a longitudinal orientation (wherein the long side of the workpiece W is parallel to the X-axis direction) or a transverse orientation (wherein the long side of the workpiece W is parallel to the Y-axis direction). Workpieces W of all sizes is positioned in a centered arrangement.

On the stationary part 59 of the workpiece θ-axis table 57, a periodical flushing box 116 of the maintenance means 23 is set up adjacent to the suction table 56 on the side near the drawing area 41 (the right side in FIG. 3).

The Y-axis table 33 is supported on a pair of front and back support stands 66, 66 extending in the Y-axis direction, and the Y-axis table spans the space between the drawing area 41 and the drawing standby area 42 and moves the seven carriage units 31 individually between the drawing area 41 and the drawing standby area 42. The Y-axis table 33 comprises seven bridge plates 61 from which the seven carriage units 31 are respectively suspended, seven Y-axis sliding tables 62 which support the seven bridge plates 61 from the sides so as to align them in the Y-axis direction, a pair of front and back Y-axis linear motors 63, 63 which extend in the Y-axis direction and move the bridge plates 61 in the Y-axis direction via their respective Y-axis sliding tables 62, two front and two back (a total of four) Y-axis guide rails 64 which extend in the Y-axis direction and guide the movement of the seven bridge plates 61, and a Y-axis linear scale (not shown) for detecting the movement positions of the carriage units 31.

When the pair of Y-axis linear motors 63, 63 is driven, the seven Y-axis sliding tables 62 can be moved independent of each other, and the seven carriage units 31 can be moved individually in the Y-axis direction. The individual movement of the seven carriage units 31 can thereby be performed with a simple structure and high precision. Of course, it is also possible to move the seven carriage units 31 collectively in the Y-axis direction by simultaneously moving the seven Y-axis sliding tables 62 in the Y-axis direction.

In the present embodiment, seven carriage units 31 are mounted in alignment on a single Y-axis table 33, but a plurality of Y-axis tables 33 may also be provided, and the seven carriage units 31 may be divided among and mounted on these tables.

Furthermore, head electrical units 97 for driving the twelve functional liquid droplet discharge heads 72 mounted on the corresponding carriage units 31 are provided on the bridge plates 61 supported on the respective Y-axis sliding tables 62, and the seven head electrical units 97 are arranged in a staggered formation so as to not interfere with each other (noise prevention). The pair of front and back support stands 66, 66, is provided with outwardly orientated brackets 67 fixed to the front and back side surfaces, respectively; and Y-axis storage boxes 68 are supported on the brackets 67. Seven Y-axis cable supports 69 (Cableveyor: registered product name) are divided into a group of four and a group of three, and are accommodated in accordance with the staggered arrangement of the seven head electrical units 97 in the two Y-axis storage boxes 68. The Y-axis cable supports 69 are configured to be capable of causing flexible flat cables connected to the head electrical units 97 to follow the movement of the carriage units 31.

Tank units (not shown) of the seven functional liquid supply units 101 are arranged in a staggered formation so as to face the head electrical units 66.

Figure 4:
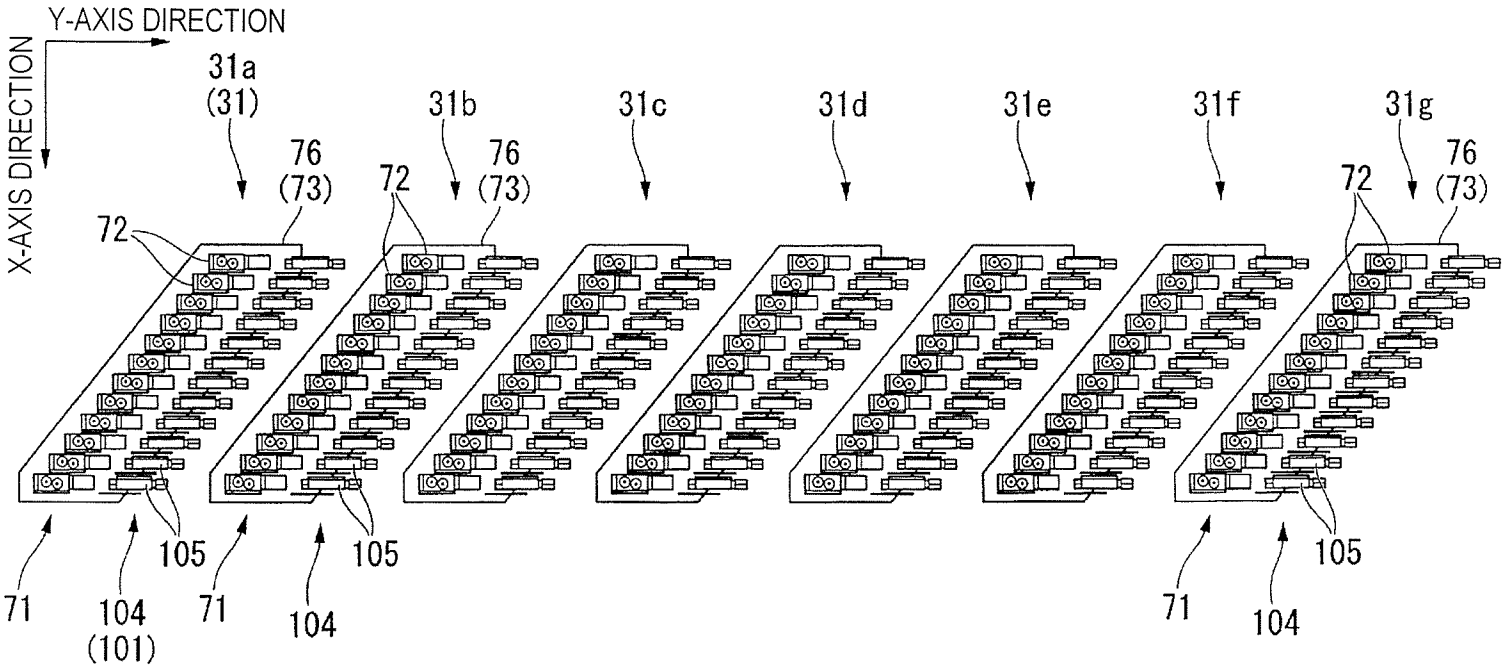
FIG. 4 is an explanatory drawing of a plurality of carriage units.

The seven carriage units 31 are suspended respectively by the seven bridge plates 61 of the Y-axis table 33 and are aligned in the Y-axis direction; and the carriage units 31 are configured from head units 71 composed of twelve functional liquid droplet discharge heads 72, and carriages 73 on which the head units 71 and valve units 104 (described hereinafter) of the functional liquid supply units 101 are mounted, as shown in FIGS. 1 and 4. The seven carriage units 31 consist of a first carriage unit 31*a*, a second carriage unit 31*b*, . . . , and a seventh carriage unit 31*g*, going in order from the drawing area 41 toward the drawing standby area 42 (from the left side in FIG. 4 toward the right side).

Each carriage 73 has a support plate 76 having a substantially square shape in a plan view for positioning and fixing a head unit 71 and a valve unit 104; a carriage main body 77 for holding the support plate 76; a head θ-axis table 78, linked to the top of the carriage main body 77, for suspending the carriage main body 77 and finely adjusting (correcting along the θ axis) the θ position of the head unit 71 via the carriage main body 77; and a head Z-axis table 79, linked to the top of a head θ-axis table 78, for finely adjusting (correcting along the Z axis) the Z position of the head unit 71 via the head θ-axis table 78 and the carriage main body 77, as shown in FIGS. 3 and 4. Though not shown in the drawings, the support plate 76 may be provided with a pair of reference pins which serve as a reference for positioning (recognizing the position) of a carriage unit 31 (head unit 71) in the X-axis, Y-axis, and θ-axis directions to enable image recognition.

The support plates 76 are configured from thick sheets made of stainless steel or the like and having substantially parallel square shapes in a plan view, wherein each of the support plates accommodates twelve functional liquid droplet discharge heads 72; and twelve attachment openings (not shown) for fixing the functional liquid droplet discharge heads 72 in place from the reverse side by means of head-holding members (not shown) are formed in each of the support plates. The support plates 76 are detachably supported on the carriage main bodies 77, and the head units 71 are mounted together with the valve units 104 on the carriages 73 via the support plates 76.

Figure 5:
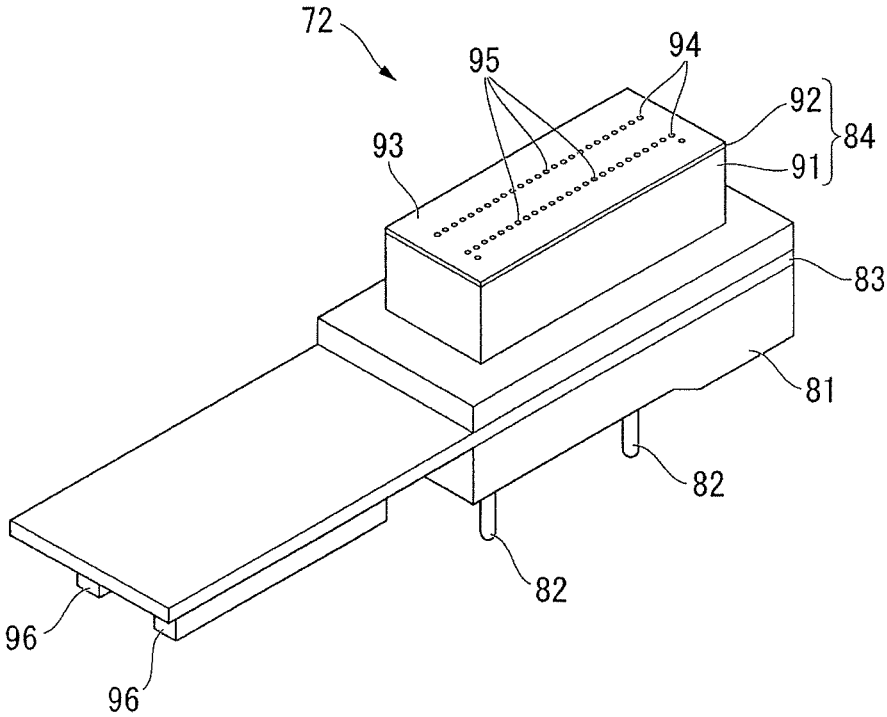
FIG. 5 is an external perspective view of a functional liquid droplet discharge head.

Each of the functional liquid droplet discharge heads 72 is a so-called double head, comprising a functional liquid feeder 81 having two connecting pins 82, two head substrates 83 joined to the functional liquid feeder 81, and a head main body 84 joined to the bottom (the top in FIG. 5) of the functional liquid feeder 81 and having therein an in-head flow channel filled with functional liquid, as shown in FIG. 5. The connecting pins 82 are connected to a functional liquid tank (not shown) via pressure adjustment valves 105 (see FIG. 4) described hereinafter, and functional liquid is supplied to the in-head flow channels of the functional liquid droplet discharge heads 72. Each head main body 84 has a cavity 91 configured from a piezoelement or the like, and a nozzle plate 92 having a nozzle surface 93 on which two nozzle rows 94, 94 are formed parallel to each other.

The nozzle rows 94 may, for example, have a length of 1 inch (about 25.4 mm), and the nozzle rows 94 are configured with 180 nozzles 95 aligned at equal pitches (about 140 am).

Since the structure of the in-head flow channels is such that the discharge from the nozzles 95 positioned at the ends is greater than the discharge from the nozzles 95 positioned in the center, ten nozzles 95 at the ends are designated as non-discharge nozzles, the 160 nozzles 95 in the center are designated as discharge nozzles, functional liquid is discharged only from the discharge nozzles, and functional liquid is not discharged from the non-discharge nozzles.

Next, the nozzle plates 92 and the cavities 91 in the functional liquid droplet discharge heads 72 will be described.

Figure 6:
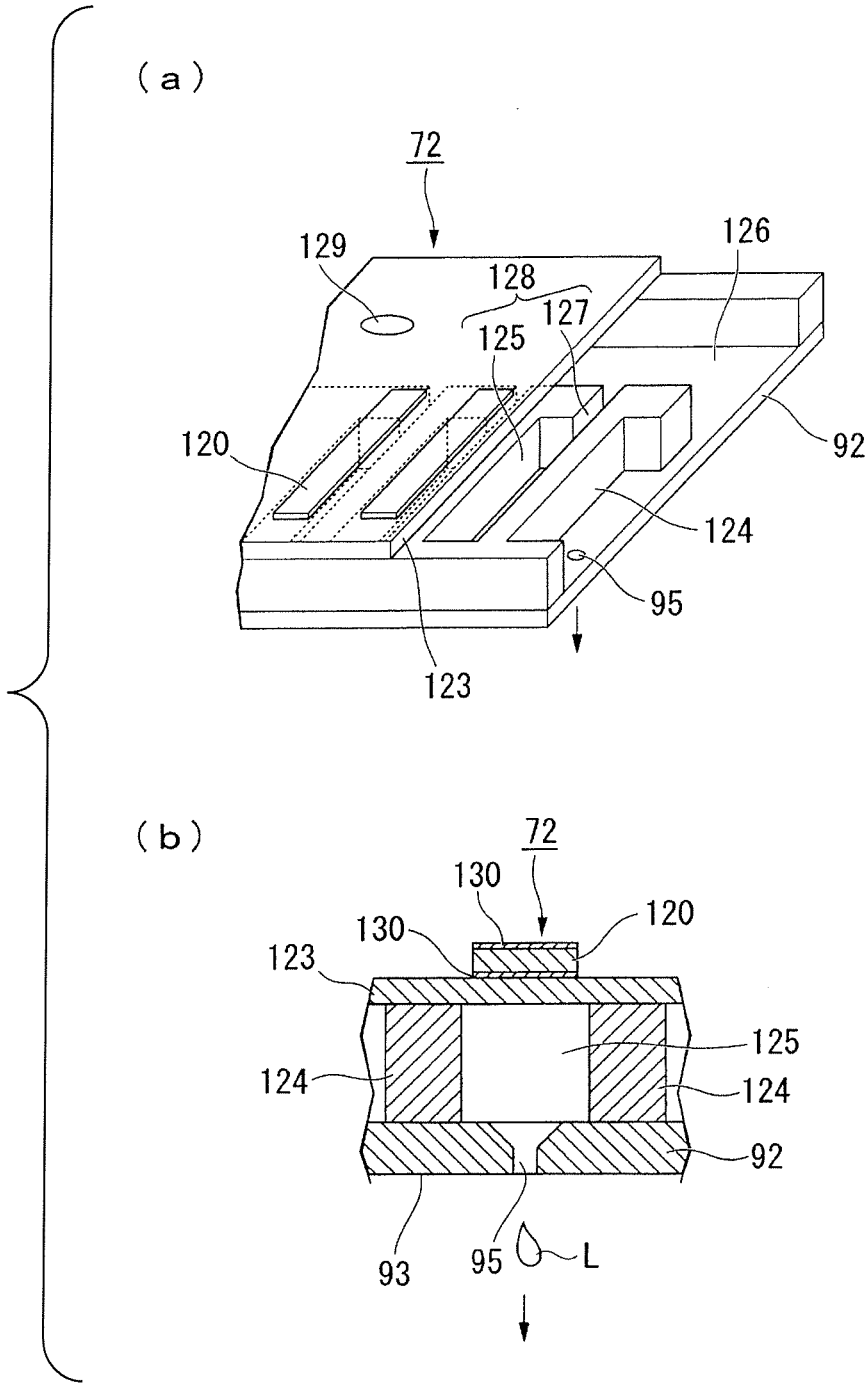
FIG. 6 is an explanatory drawing of a droplet discharge head.

FIG. 6(*a*) is an explanatory drawing of the structure of one of the functional liquid droplet discharge heads 72, and FIG. 6(*be*) is front cross-sectional view thereof. In FIG. 6, the functional liquid droplet discharge head 72 has been turned upside down from FIG. 5.

In the functional liquid droplet discharge heads 72, liquid chambers are compressed, for example, by the piezoelements; the liquid is discharged by the resulting waves of pressure; and the droplet discharge heads each have a plurality of nozzles 95 aligned in a plurality of rows. To describe one example of the structure of the functional liquid droplet discharge heads 72, the functional liquid droplet discharge heads 72 each comprise, for example, a stainless steel nozzle plate 92 and a vibrating sheet 123 which are bonded together via a partitioning member (reservoir plate) 124, as shown in FIG. 6(*a*). Between the nozzle plate 92 and the vibrating sheet 123, a plurality of spaces 125 and a liquid reservoir 126 are formed as a flow-channel forming part by the partitioning member 124. The spaces 125 and the interior of the liquid reservoir 126 are filled with ink (a liquid), and the spaces 125 and the liquid reservoir 126 are communicated (connected) via supply ports 127. Specifically, the spaces 125 and the supply ports 127 form flow channels 128 for feeding the ink filled in the liquid reservoir 126 to the nozzles 95.

The nozzles (nozzle openings) 95 for spraying ink from the spaces 125 are formed in the nozzle plate 92. A hole 129 for supplying ink to the liquid reservoir 126 is formed in the vibrating sheet 123.

Piezoelectric elements (piezoelements) 120 are bonded to each vibrating sheet 123 on the surface on the opposite of the surface facing the spaces 125, as shown in FIG. 6(*be*). The piezoelectric elements 120 are each configured such that a piezoelectric material is sandwiched between a pair of electrodes 130 and the piezoelectric material contracts when an electric current is passed through the pair of electrodes 130. A piezoelectric element is provided for each nozzle 95. The vibrating sheet 123 to which the piezoelectric elements 120 are bonded in this structure is designed so as to flex outward integrally and simultaneously with the piezoelectric elements 120, whereby the capacity of the spaces 125 increases. Therefore, an amount of ink equivalent to the increased capacity in the spaces 125 flows in from the liquid reservoir 126 via the supply ports 127. When the electric current to the piezoelectric elements 120 is terminated, the piezoelectric elements 120 and the vibrating sheet 123 both regain their original shapes. Therefore, the spaces 125 also regain their original capacity, for which reason the pressure of the ink inside the spaces 125 increases, and ink droplets L are discharged from the nozzles 95 toward the substrate.

Specifically, two connectors 96, 96 are provided to each head substrate 83; and the connectors 96 are connected to the head electrical units 97 (head drivers 141, see FIG. 8) via flexible flat cables. When a drive waveform is applied to the cavities 91 (electrodes 130) from the controller 24 via the head electrical units 97, functional liquid droplets are discharged from the nozzles 95 by the pumping action applied to the cavities 91 by the flexing of the vibrating sheets 123. Consequently, the amount of droplets discharged and the discharge time are independently controlled for each nozzle 95 by controlling the amplitude (magnitude of the applied voltage) and cyclicity of the drive waveforms applied to the cavities 91.

The present embodiment is configured such that a drawing process is performed by discharging functional liquid onto the workpiece W from the functional liquid droplet discharge heads 72 in the drawing area 41 while a group of operating units 36 composed of at least one carriage unit 31 of the seven carriage units 31 is moved in the X-axis direction relative to the workpiece W.

The droplet discharge system of the functional liquid droplet discharge heads 72 may be a system other than a system of a piezo-jet type using the piezoelectric elements 120, e.g., a system that uses electrothermal converters as energy-generating elements.

The functional liquid supply units 101 of the functional liquid supply means 34 each have a tank unit composed of twelve functional liquid tanks for storing functional liquid, a valve unit 104 composed of twelve pressure adjustment valves 105 for adjusting the hydraulic head pressure between the functional liquid tanks and the functional liquid droplet discharge heads 72, twelve tank-side liquid-supply tubes (not shown) for connecting the twelve functional liquid tanks and the twelve pressure adjustment valves 105, and twenty-four head-side liquid-supply tubes (not shown) for connecting the twelve pressure adjustment valves 105 and (the two connecting pins 82 of each of the two groups of) the twelve functional liquid droplet discharge heads 72 via branching joints (not shown).

The image recognition means 35 has two workpiece recognition cameras 106 (see FIG. 8) for recognizing images of two workpiece alignment marks (not shown) formed on the lengthwise portions of the workpiece W, the workpiece recognition cameras being placed so as to face the front and back sides of the workpiece-conveying area 43; a head recognition camera 107 (see FIG. 8) for recognizing images of two reference pins of each carriage 73 (support plate 76), the head recognition camera being linked to the X-axis air slider 52 of the X-axis table 32; and two dot recognition cameras 108 (see FIG. 8) for photographing and recognizing images of functional liquid droplets (dots) from above which have been discharged onto the workpiece W or the like, the dot recognition cameras being mounted in a manner that allows them to be moved in the Y-axis direction by camera movement mechanisms (not shown) provided to the Y-axis table 33. The positions of the workpiece W and head units 71 described above are corrected based on the image recognition results of the cameras.

The following is a simple description, made with reference to FIGS. 1 through 3, of the discharge action, i.e., the drawing action, by the drawing device 22 on the workpiece W. First, as preparations preceding functional liquid discharge, a workpiece W is positioned on the suction table 56 by the aforementioned workpiece-conveying device 2, and the position of the workpiece W is corrected by correcting the position of the workpiece in the θ-axis direction with the aid of the workpiece θ-axis table 57 and correcting the positional data about the workpiece W in the X-axis and Y-axis directions. The group of operating units 36 that moves in the drawing area 41 and a group of drawing standby units 37 that moves in the drawing standby area 42 are group one in front of the other (the details of which are described hereinafter). The position of the head units 71 of the group of operating units 36 that move in the drawing area 41 is corrected by correcting the position of the units in the θ-axis direction with the aid of the head θ-axis table 78, and the position of the units in the Y-axis direction with the aid of the Y-axis table 33, and correcting the positional data about the head units 71 in the X-axis direction.

After the position of the workpiece W and the head units 71 has been corrected, the drawing device 22 causes the workpiece W to move one way in the X-axis direction by means of the X-axis table 32, and drives the functional liquid droplet discharge heads 72 of the group of operating units 36 in a synchronized selective fashion to discharge functional liquid onto the workpiece W under control from the controller 24 (the control unit 132). The functional liquid is then discharged again onto the workpiece W while the workpiece W is moved back the other way. Thus, drawing is performed on the workpiece W by repeatedly moving the workpiece W back and forth in the X-axis direction and driving the functional liquid droplet discharge heads 72 multiple times. Specifically, while the group of operating units 36 is moved in the X-axis direction relative to the workpiece W which faces the drawing area 41, functional liquid is discharged onto the workpiece W from the functional liquid droplet discharge heads 72 of the group of operating units 36, and the drawing process is performed.

In this drawing process, the configuration may also be designed such that the functional liquid is discharged only while the workpiece W is moving one way. Another option is a configuration in which the workpiece W is stationary and the group of operating units 36 is moved in the X-axis direction. Furthermore, in the present embodiment, the width of the drawing target on the workpiece W and the length of the group of partially drawn lines of the group of operating units 36 correspond to each other as described above, but another option is a configuration in which the width of the drawing target on the workpiece W is greater than that of the group of partially drawn lines of the group of operating units 36, in which case, while the group of operating units 36 is moved back and forth relative to the workpiece W, the functional liquid droplet discharge heads 72 are driven to perform discharge scanning (main scanning), the group of operating units 36 is then moved in the Y-axis direction (sub-scanning) in proportion to the length of the group of partially drawn lines by the Y-axis table 33, and main scanning is repeated on the workpiece W. Main scanning and sub-scanning are repeated multiple times, and droplet discharge is performed from one end of the workpiece W to the other.

Figure 7:
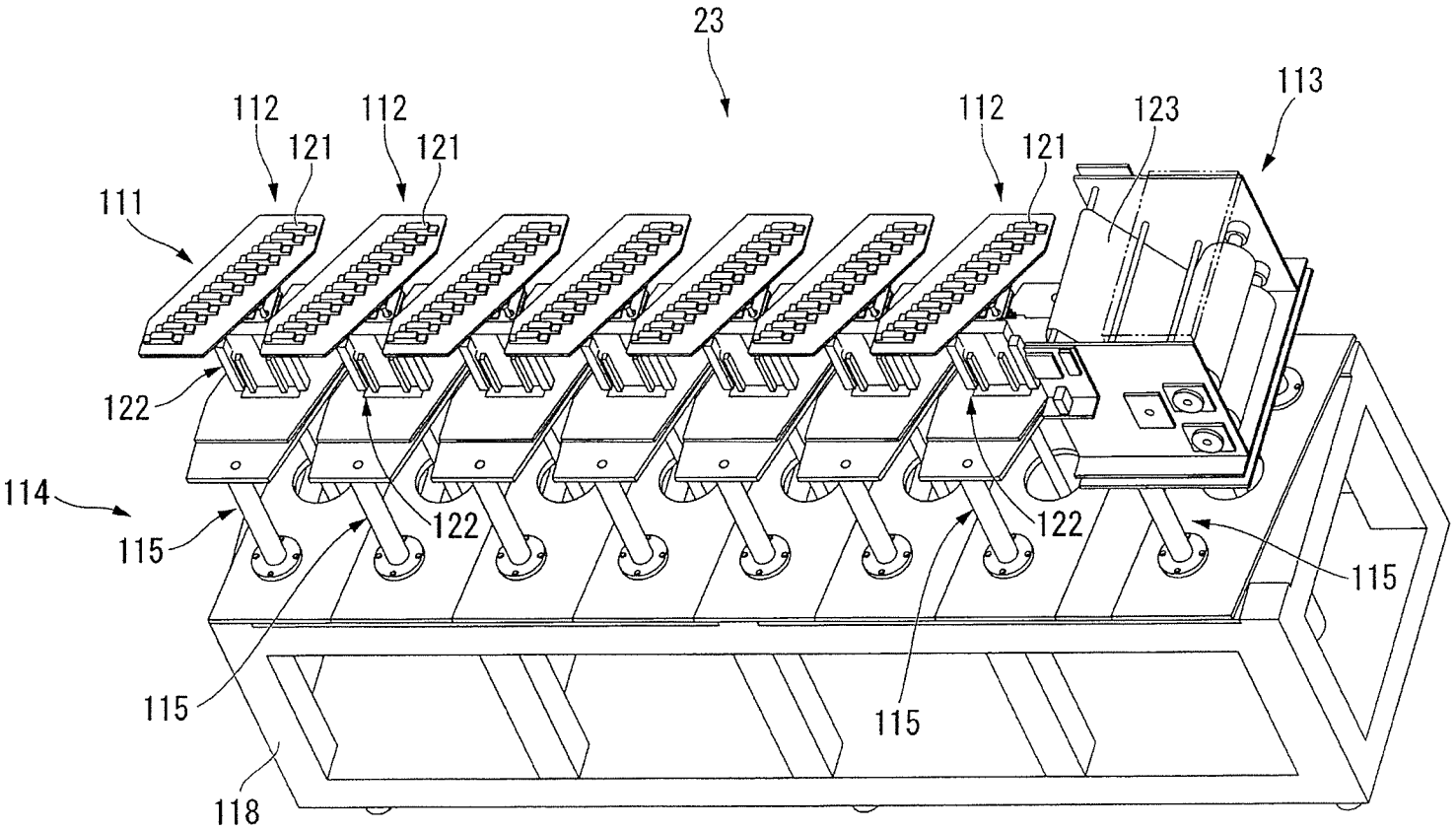
FIG. 7 is an external perspective view of the maintenance means.

The following is a description, made with reference to FIGS. 2 and 7, of the maintenance means 23 in the droplet discharge apparatus 1, and the function maintenance/restoration process performed thereby on the functional liquid droplet discharge heads 72. The maintenance means 23 keeps the functional liquid droplet discharge heads 72 in a state of maintaining the discharge function, and also maintains/restores the discharge function. The maintenance means 23 has an aspiration unit 111 for holding functional liquid droplet discharge heads 72 by vacuum and forcefully expelling functional liquid from the functional liquid droplet discharge heads 72, a wiping unit 113 for wiping off the nozzle surfaces 93 of functional liquid droplet discharge heads 72 soiled by deposited functional liquid, and unit lifting means 114 configured from eight unit lifting mechanisms 115 for supporting the seven divided aspiration units 112 (described hereinafter) of the aspiration unit 111 and the wiping unit 113 in a manner that allows them to be raised and lowered individually; wherein these components are supported on an angle mount 118 and placed in the drawing standby area 42. Furthermore, the maintenance means 23 has a periodical flushing box 116 placed on the above-described workpiece θ-axis table 57, and a pair of pre-discharge flushing boxes (not shown) placed at the front and rear sides of the positioning table 51.

The aspiration unit 111 has seven divided aspiration units 112 aligned in the Y-axis direction in correspondence with the seven carriage units 31. The divided aspiration units 112 face the carriage units 31 from below, and each comprise twelve caps 121 for hermetically sealing the nozzle surfaces 93 of twelve respective functional liquid droplet discharge heads 72, a cap support member 122 for supporting the twelve caps 121 while allowing the caps to be raised and lowered, and an ejector (not shown) for applying aspiration force to the functional liquid droplet discharge heads 72 via the sealed caps 121.

The twelve caps 121 are placed on the cap support member 122 in correspondence with the alignment of the twelve functional liquid droplet discharge heads 72 mounted on each carriage 73. Therefore, in the entire aspiration unit 111, the arrangement of 12×7 caps 121 imitates the arrangement pattern of all of the functional liquid droplet discharge heads 72 of the seven carriage units 31, and the respective caps 121 corresponding to all of the functional liquid droplet discharge heads 72 can be sealed off once. Furthermore, functional liquid that has thickened inside the functional liquid droplet discharge heads 72 can be removed by driving the ejector while the caps 121 are sealed against the nozzle surfaces 93, and thereby drawing in the functional liquid from the nozzles 95 by aspiration.

Therefore, the aspiration unit 111 can prevent the functional liquid in the nozzles 95 of the functional liquid droplet discharge heads 72 from drying, and keep the functional liquid droplet discharge heads 72 in a functioning state without using a complicated mechanism, by using the caps 121 to hermetically seal the functional liquid droplet discharge heads 72. The aspiration unit 111 can also expel thickened functional liquid by suctioning the liquid from the nozzles 95 of the functional liquid droplet discharge heads 72 that are made airtight by the caps 121.

The wiping unit 113 is disposed on the side of the drawing standby area 42 that faces the drawing area 41, i.e., between the drawing area 41 and the aspiration unit 111. The nozzle surfaces 93 soiled by the deposited functional liquid are wiped off using a wiping sheet 123 impregnated with a cleaning fluid by the aspiration or the like of the functional liquid droplet discharge heads 72. With this arrangement, the wiping unit 113 is designed so that the aspiration action of the aspiration unit 111 is ended, the wiping unit sequentially faces each of the carriage units 31 that have moved into the drawing area 41, and the functional liquid droplet discharge heads 72 are wiped off. The discharge function of functional liquid droplet discharge heads 72 whose nozzles have been clogged can be restored by performing the aspiration process described above and wiping off the functional liquid deposited on the nozzle surfaces 93 by the aspiration process.

The periodical flushing box 116 is disposed above the workpiece θ-axis table 57 and is designed to receive the flushed material expelled when the drawing on the workpiece W is temporarily stopped, as shown in FIG. 3. The periodical flushing box 116 faces the drawing area 41 and receives the flushed material from the functional liquid droplet discharge heads 72 when the positioning table 51 is placed facing the workpiece-conveying area 43 in order to replace the workpiece W.

Though not shown in the drawings, a pair of pre-discharge flushing boxes is used to receive "pre-discharge" flushed material expelled immediately before functional liquid is discharged onto the workpiece W. The boxes are placed so as to enclose the positioning table 51 from both sides in the X-axis direction. It is thereby made possible to receive the flushed material expelled immediately before the functional liquid droplet discharge heads 72 are driven to discharge the liquid in accompaniment with the reciprocating movement of the workpiece W.

The periodical flushing box 116 and the pair of pre-discharge flushing boxes have rectangular box shapes in a plan view and are provided on the bottom surfaces thereof with absorbing members (not shown) for absorbing functional liquid. Since the long sides (in the Y-axis direction) of the flushing boxes are formed in accordance with the length of the aforementioned drawing line Lm having the maximum width, they can receive the flushed material expelled from the functional liquid droplet discharge heads 72 even in cases in which the group of operating units 36 includes all of the carriage units 31.

Figure 8:
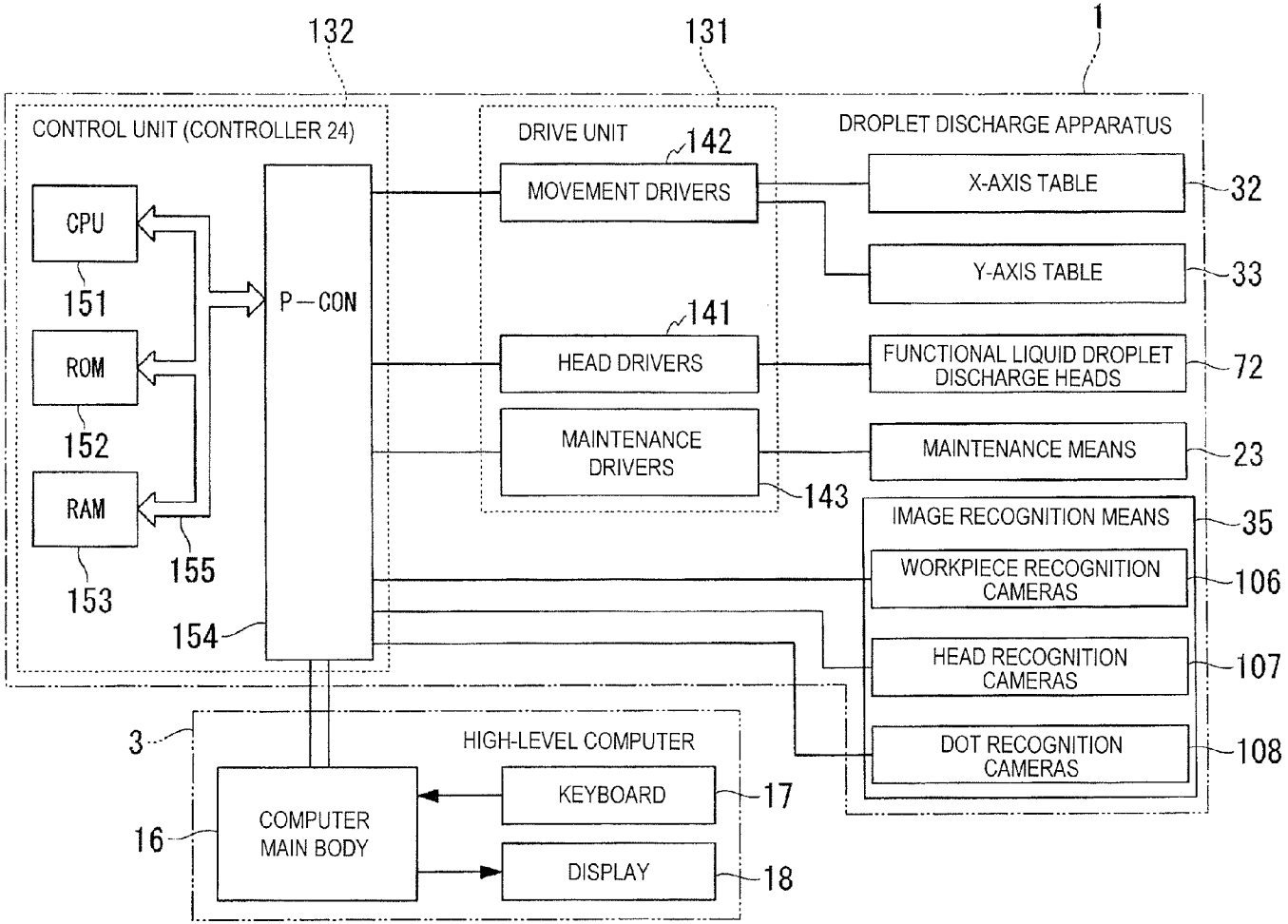
FIG. 8 is a block diagram in which the control system of the droplet discharge apparatus is described.

The following is a simple description, made with reference to FIG. 8, of the control system of the entire droplet discharge apparatus 1. The control system of the droplet discharge apparatus 1 essentially comprises the high-level computer 3; a drive unit 131 having various drivers for driving the functional liquid droplet discharge heads 72, the X-axis table 32, the Y-axis table 33, the maintenance means 23, and other components; and the control unit 132 (controller 24) for collectively controlling the droplet discharge apparatus 1, including the drive unit 131.

The high-level computer 3 is configured with a keyboard 17, a display 18 for displaying images of results and the like inputted from the keyboard 17, and other components connected to a computer main body 16, which is itself connected to the controller 24.

The drive unit 131 comprises the head drivers 141 for controlling the driving of the functional liquid droplet discharge heads 72 to cause the heads to discharge the liquid, movement drivers 142 for drivably controlling the motors of the X-axis table 32 and the Y-axis table 33, and maintenance drivers 143 for drivably controlling the aspiration unit 111, the wiping unit 113, and the unit lifting mechanisms 115 of the maintenance means 23.

The control unit 132 comprises a CPU 151, a ROM 152, a RAM 153, and a P-CON 154, which are connected to each other via a bus 155. The ROM 152 has a control program region for storing control programs and the like processed by the CPU 151, and a control data region for storing control data and the like for performing the drawing operation and image recognition.

The RAM 153 has, in addition to various registers, a drawing data storage unit for storing drawing data for discharging the functional liquid onto the workpiece W, a positional data storage unit for storing positional data about the workpiece W and the functional liquid droplet discharge heads 72, a settings storage unit for storing various settings (settings and other data about the group of operating units 36 and group of drawing standby units 37, described hereinafter) inputted from the keyboard 17 by an operator, and other various storage units, which are used as operating regions for the control process.

In addition to the various drivers of the drive unit 131, various cameras of the image recognition means 35 are also connected to the P-CON 154, and a logic circuit is provided for compensating for the function of the CPU 151 and handling interface signals with peripheral circuits. Therefore, the P-CON 154 receives various commands and the like from the high-level computer 3 via the bus 155, either with or without processing the commands first, and outputs data and control signals to the drive unit 131 in conjunction with the CPU 151, either with or without processing the data and control signals first, after they have been outputted to the bus 155 from the CPU 151 or another component.

The CPU 151 controls the entire droplet discharge apparatus 1 by inputting various detection signals, various commands, various data, and the like via the P-CON 154 in accordance with the control programs in the ROM 152; processing the various data and the like in the RAM 153; and then outputting various control signals to the drive unit 131 and other components via the P-CON 154. For example, the CPU 151 may control the functional liquid droplet discharge heads 72, the X-axis table 32, and the Y-axis table 33, and perform drawing on the workpiece W under predetermined droplet discharge conditions and predetermined movement conditions.

First Embodiment of Stirring Method

Figure 9:
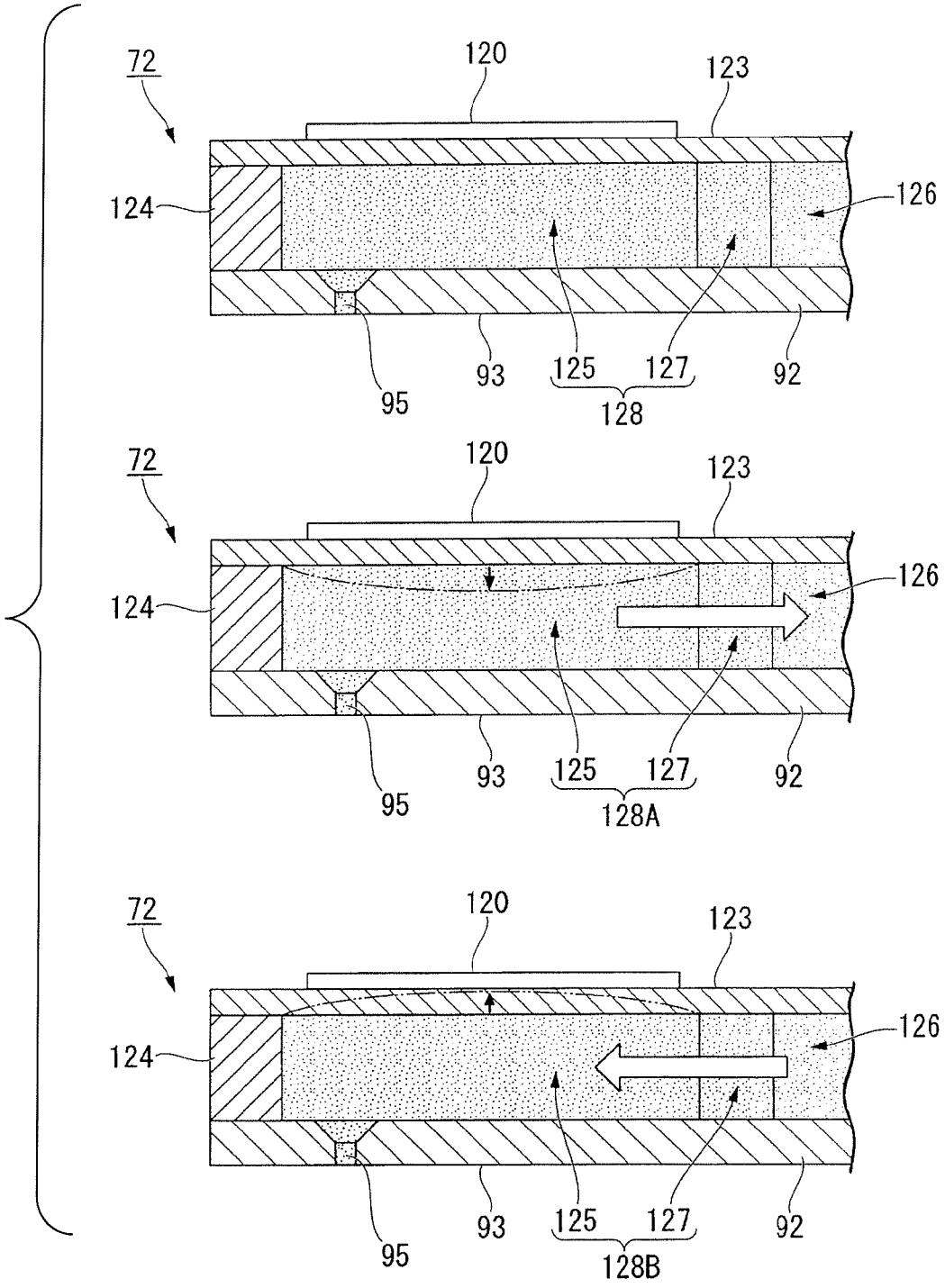
FIG. 9 is a cross-sectional view for describing the process of stirring ink.
Figure 10:
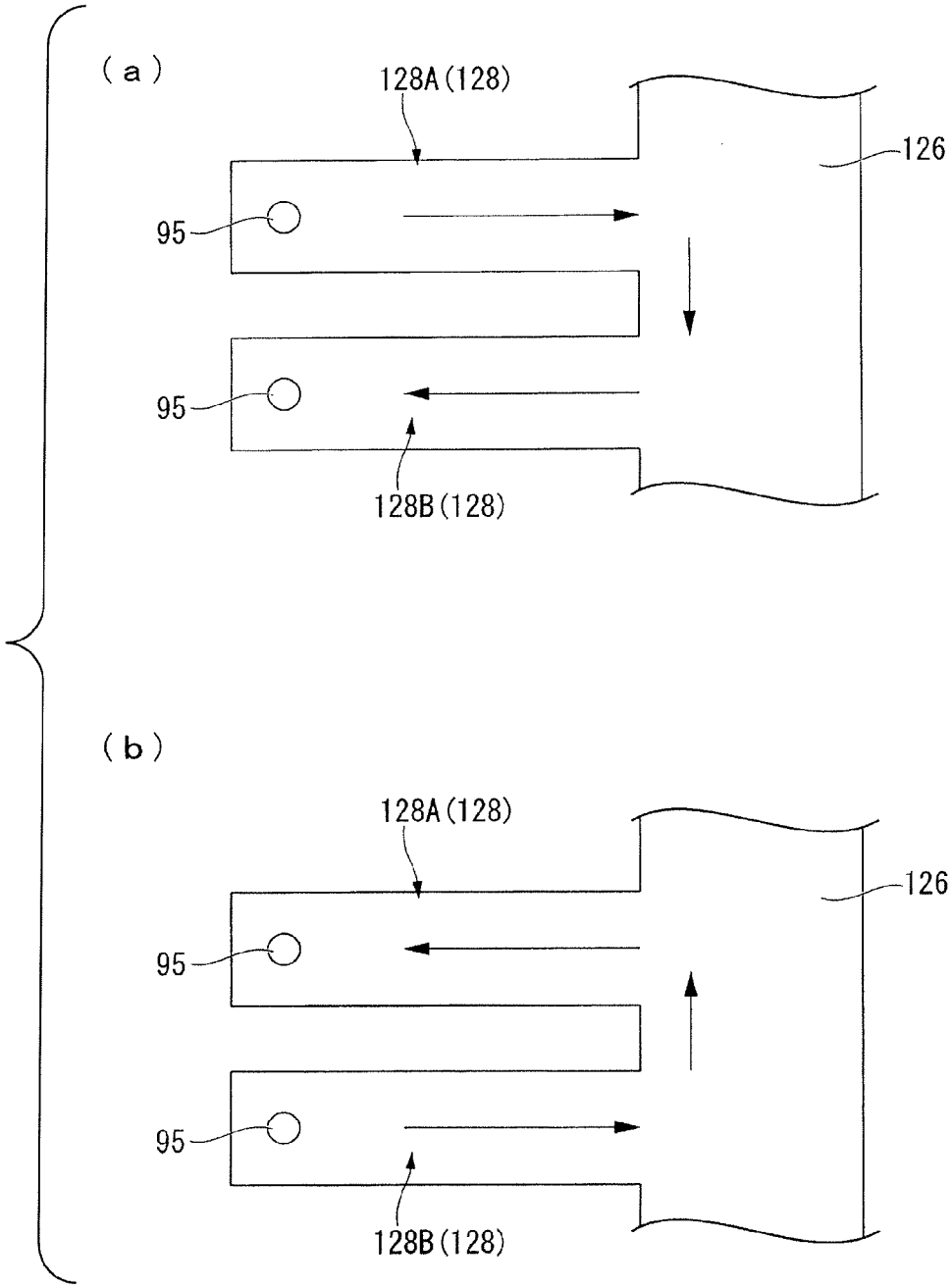
FIG. 10 is a plan view for describing the process of stirring ink.

The following is a description, made with reference to FIGS. 9 and 10, of the method for stirring ink (liquid) inside the functional liquid droplet discharge heads 72 in the droplet discharge apparatus 1 described above.

FIG. 10 is a partially enlarged plan view of adjacent flow channels 128A, 128B and a liquid reservoir 126, FIG. 9(*be*) is a view of the flow channel 128A in a lengthwise cross section, and FIG. 9(*c*) is a view of the flow channel 128B in a lengthwise cross section.

The depiction of electrodes 130 is omitted in the piezoelectric elements 120 in FIG. 9. The depiction of the flow channels 128A, 128B is simplified in FIG. 10.

First, the piezoelectric elements 120 corresponding to the adjacent flow channels 128A, 128B are driven in mutually different states from a state in which no electric current is supplied to the piezoelectric elements 120, as shown in FIG. 9(*a*). Specifically, the piezoelectric element 120 in the flow channel 128A (referred to for convenience as the piezoelectric element 120A) is driven (an electric current is supplied to the electrode 130) as shown in FIG. 9(*be*), the piezoelectric element 120 in the flow channel 128B (referred to for convenience as the piezoelectric element 120B) is driven in the opposite direction (opposite phase) of the piezoelectric element 120A in synchronization with the displacement of the vibrating sheet 123 toward the space 125 (flow channel 128A) as shown in FIG. 9(*c*), and the vibrating sheet 123 is displaced in a direction away from the space 125 (flow channel 128B).

The driving of these piezoelectric elements 120A, 120B is controlled by the controller 24 as a drive control device.

Since the capacity of the flow channel 128A is reduced by the displacement of the vibrating sheet 123 in the flow channel 128A, there is an increase in the pressure of ink in the space 125. At this time, the piezoelectric element 120A is driven with an amplitude (so-called very low amplitude) insufficient for discharging ink from the nozzle opening 95, and the ink therefore flows from the flow channel 128A to the liquid reservoir 126, as shown by the arrows in FIGS. 9(*be*) and 10(*a*), without being discharged from the nozzle opening 95.

Since the capacity of the flow channel 128B is increased by the displacement of the vibrating sheet 123 in the flow channel 128B, there is a decrease in the pressure of the ink in the space 125. At this time, the piezoelectric element 120B is driven at very low amplitude as described above, and air therefore does not flow in through the nozzle opening 95 and compensate for the pressure drop in the ink. Consequently, the pressure of the ink in the flow channel 128B decreases, causing the ink to flow from the liquid reservoir 126 to the flow channel 128B, as shown by the arrows in FIGS. 9(*c*) and 10(*b*).

The flow of ink in mutually opposite directions in the flow channel 128A and flow channel 128B also allows ink to flow from the flow channel 128A toward the flow channel 128B in the liquid reservoir 126.

In other words, positive pressure is applied by the piezoelectric element 120A to the ink in the flow channel 128A while negative pressure is applied by the piezoelectric element 120B via the ink in the flow channel 128B and the liquid reservoir 126, resulting in a flow in which the force is about twice the pressure applied by the piezoelectric element 120A.

When the driven directions of the piezoelectric elements 120A, 120B are reversed, negative pressure is applied to the ink in the flow channel 128A and positive pressure is applied to the ink in the flow channel 128B, which is the opposite of what is described above, and the ink flow direction is reversed from the direction shown in FIG. 10(*a*), as shown in FIG. 10(*b*).

Consequently, the ink can be stirred by synchronously driving the piezoelectric elements 120A, 120B and inducing vibration while inverting the driven directions to thereby cause the ink to flow back and forth with a force about twice that of the piezoelectric elements 120A, 120B in the flow channels 128A, 128B.

Thus, in the present embodiment, the drive conditions of the piezoelectric elements 120A, 120B of the adjacent flow channels 128A, 128B are varied from each other, making it possible to efficiently stir the ink because the ink is caused to flow over greater distances even when the piezoelectric elements 120A, 120B are driven to an extent (microvibration) insufficient to discharge ink from the nozzle openings 95. Therefore, in the present invention, ink can be effectively stirred even in the flow channels 128A, 128B disposed at a distance from the nozzle openings 95, in which sufficient stirring has not been possible in conventional practice. Consequently, in the present embodiment, the occurrence of precipitation can be minimized for nonaqueous solvent-based inks in which a pigment is used as the coloring material, as well as for dispersion-based inks, UV curing inks, and other inks that can form a precipitate. Ink discharge problems and the like caused by precipitation or the like can be effectively avoided, and a high-quality device can be manufactured.

In the present embodiment, ink is stirred in the liquid reservoirs 126 as well, making it possible for precipitation to be minimized over a wider range, ink discharge problems and the like caused by precipitation or the like to be more effectively avoided, and a higher quality device to be manufactured.

Second Embodiment of Stirring Method

Next, a second embodiment of the stirring method according to the present invention will be described with reference to FIG. 11.

The first embodiment was configured such that the piezoelectric elements 120 in adjacent flow channels 128 were driven differently from each other, but in the second embodiment, a plurality of flow channel groups composed of pluralities of flow channels 128 is provided, and the drive conditions of the piezoelectric elements of adjacent flow channel groups are varied from each other.

Figure 11:
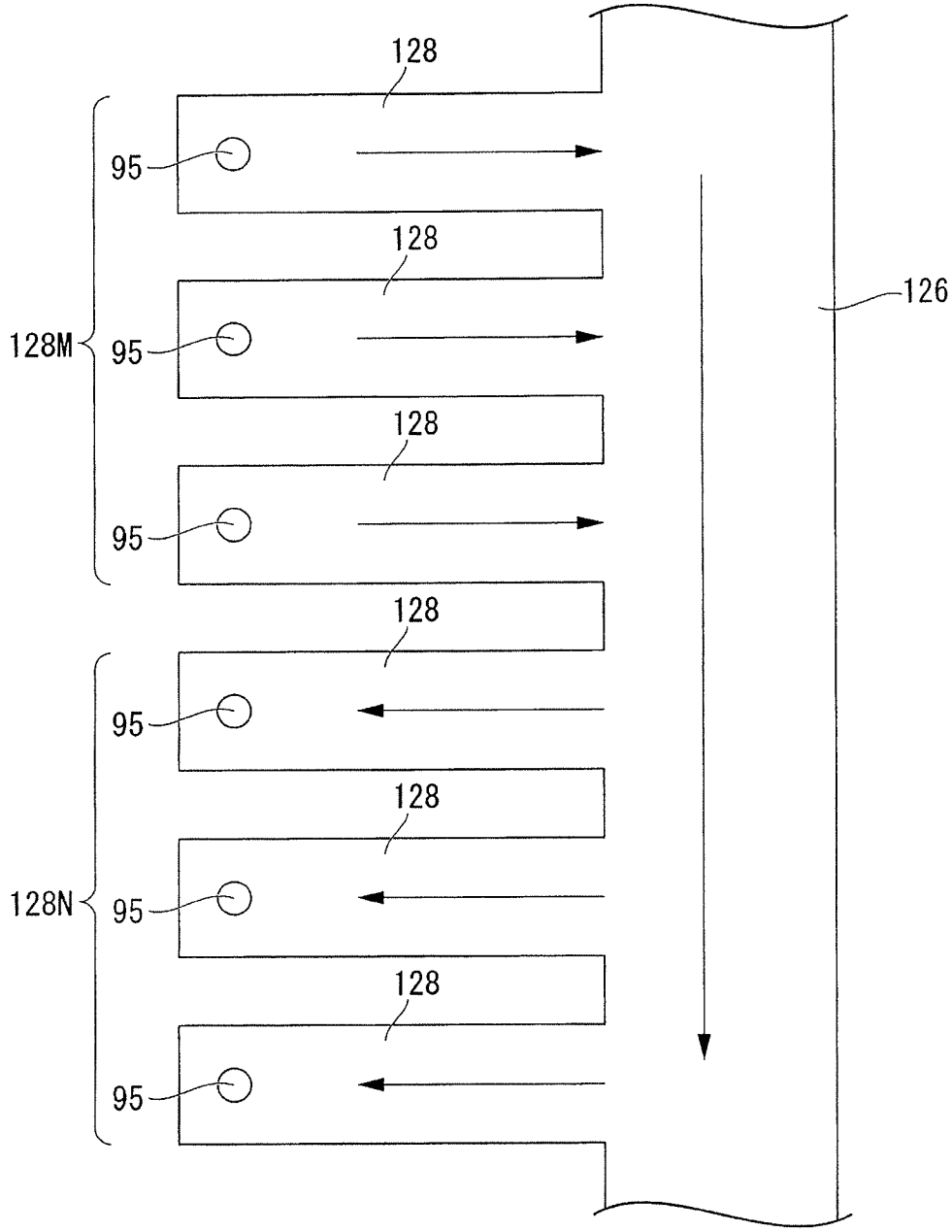
FIG. 11 is a plan view for describing the process of stirring ink in the second embodiment.

Provided in the present embodiment are flow channel groups 128M, 128N composed of three flow channels 128 from among a plurality of flow channels 128, as shown in FIG. 11. The piezoelectric elements 120 in the flow channel groups 128M, 128N are driven substantially identically to each other and in synchronism with each other (drive waveforms have substantially identical frequencies, amplitudes, and phases), and the piezoelectric elements 120 in the flow channel group 128M and the flow channel group 128N are driven in opposite phases.

The driving of these piezoelectric elements 120 is also controlled by the controller 24 as a drive control device so as to be too small for ink to be discharged from the nozzle openings 95.

When the piezoelectric elements 120 in the flow channel group 128M are driven in a direction in which positive pressure is applied to the ink in the flow channels 128, as shown in FIG. 9(*b*), the ink in the flow channels 128 of the flow channel group 128M flows toward the liquid reservoir 126.

When the piezoelectric elements 120 in the flow channel group 128N are driven in a direction in which negative pressure is applied to the ink in the flow channels 128, as shown in FIG. 9(*c*), the ink in the liquid reservoir 126 flows to the flow channels 128 of the flow channel group 128N.

At this time, ink flows into the liquid reservoir 126 from the plurality of flow channels 128 in the flow channel group 128M, and flows toward the plurality of flow channels 128 in the flow channel group 128N. Ink therefore can flow in a large amount.

Consequently, in the present embodiment, the piezoelectric elements 120 in the flow channel groups 128M, 128N are driven synchronously and vibrated while driven in inverted directions, whereby the ink can be caused to flow in larger amounts to the liquid reservoir 126 and more-effective stirring can be achieved in the flow channels, in addition to the same action and effects as those of the first embodiment.

Figure 12:
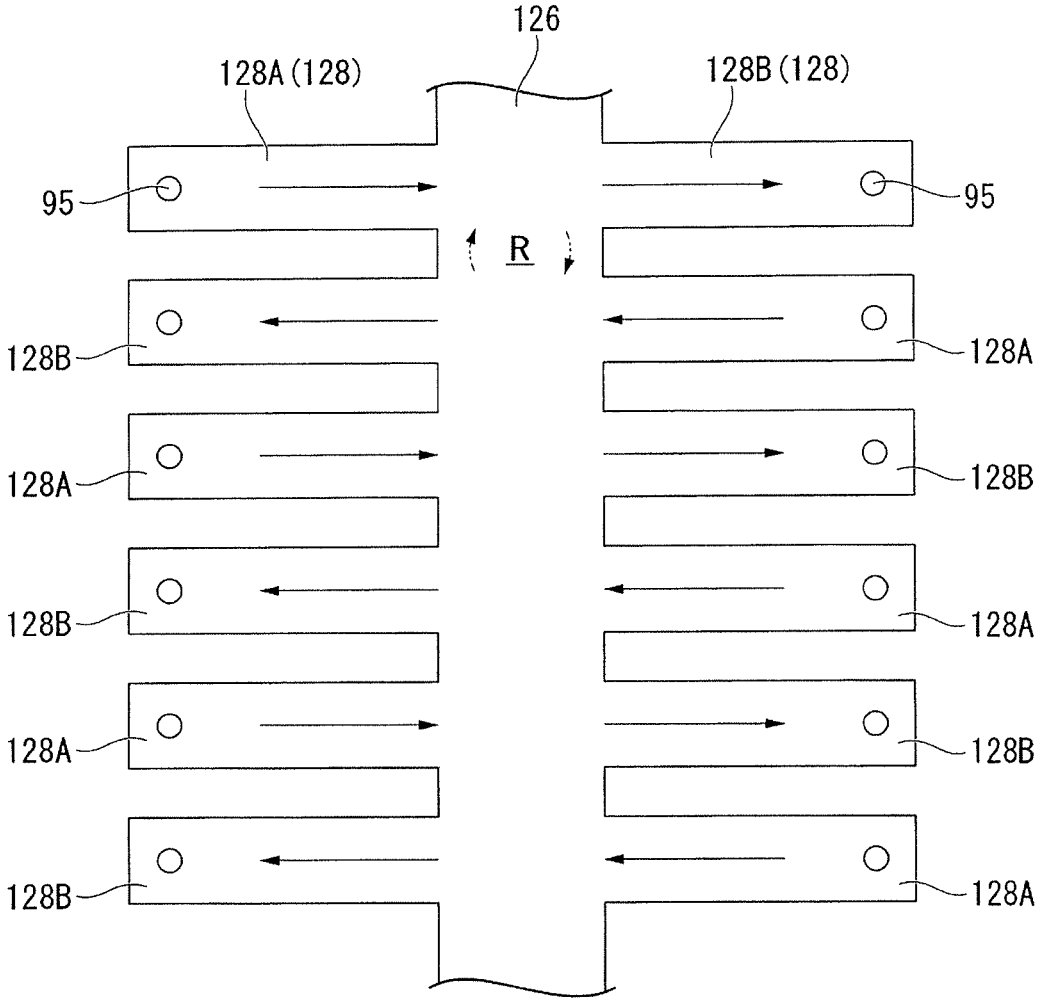
FIG. 12 is a plan view for describing the process of stirring ink in another embodiment.

The embodiment described above had a configuration in which flow channels 128 were disposed at intervals along the direction of extension of the liquid reservoir 126 on one side of the liquid reservoir 126 extending in one direction, but the configuration is not limited to this option alone, and the flow channels may be disposed on both sides of the liquid reservoir 126 as shown in FIG. 12, for example. In this case, flow channels 128 on one side of the liquid reservoir 126 and flow channels 128 on the other side are flow channels that are adjacent in a direction orthogonal to the direction of extension of the liquid reservoir 126, and the same action and effects as the first embodiment described above can be achieved by driving the piezoelectric elements that correspond to the flow channels in opposite phases.

At this time, the piezoelectric elements 120 in the flow channels 128 to one side of the liquid reservoir 126 are driven in the same state, and the piezoelectric elements 120 in the flow channels 128 to the other side are driven in the opposite phase of the first side, whereby the same action and effects can be obtained as in the case of providing flow channel groups demonstrated in the second embodiment described above.

In this case, there is a possibility that ink will not sufficiently flow through the areas (e.g., the area R) positioned between flow channels 128 in the direction of extension in the liquid reservoir 126.

Therefore, the piezoelectric elements are driven in different drive conditions (in opposite phases) from each other in the flow channels that are adjacent in the direction of extension of the liquid reservoir 126, as shown in FIG. 12.

Adequate stirring can thereby be achieved because a flow is created in the area R around an axis parallel to the direction (normal direction) orthogonal to the flow surface, as shown by the double-dashed lines in FIG. 12.

Method for Manufacturing Color Filters

Figure 13:
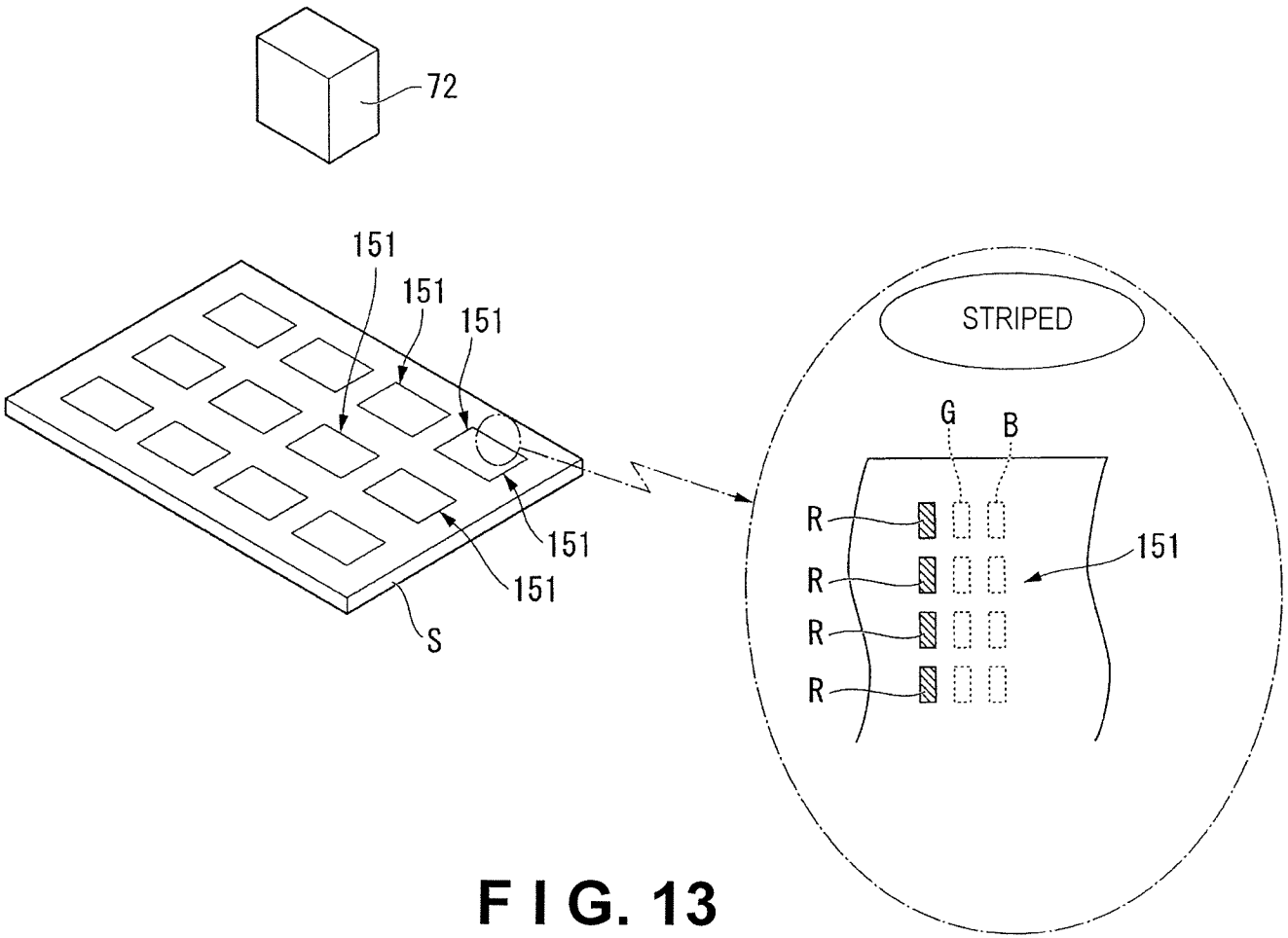
FIG. 13 is an explanatory drawing of color filter areas in a substrate.

The following is a description of an example of the method for manufacturing a color filter using the droplet discharge apparatus 1 according to the present embodiment. FIG. 13 is an explanatory drawing of color filter areas 151 on a substrate S. The method for manufacturing a color filter using the droplet discharge apparatus 1 can be applied when a plurality of color filter areas 151 is formed in a matrix configuration on a rectangular substrate S in order to increase productivity. The color filter areas 151 can be used as individual color filters suited to a liquid crystal display device by the subsequent cutting of the substrate S. In each of the color filter areas 151, R ink, G ink, and B ink are arranged in a predetermined pattern. In the example shown, an arrangement formed by a striped pattern according to the prior art is depicted, as shown in FIG. 13. Instead of stripes, the formation pattern may also be mosaic, delta, or square.

Figure 14:
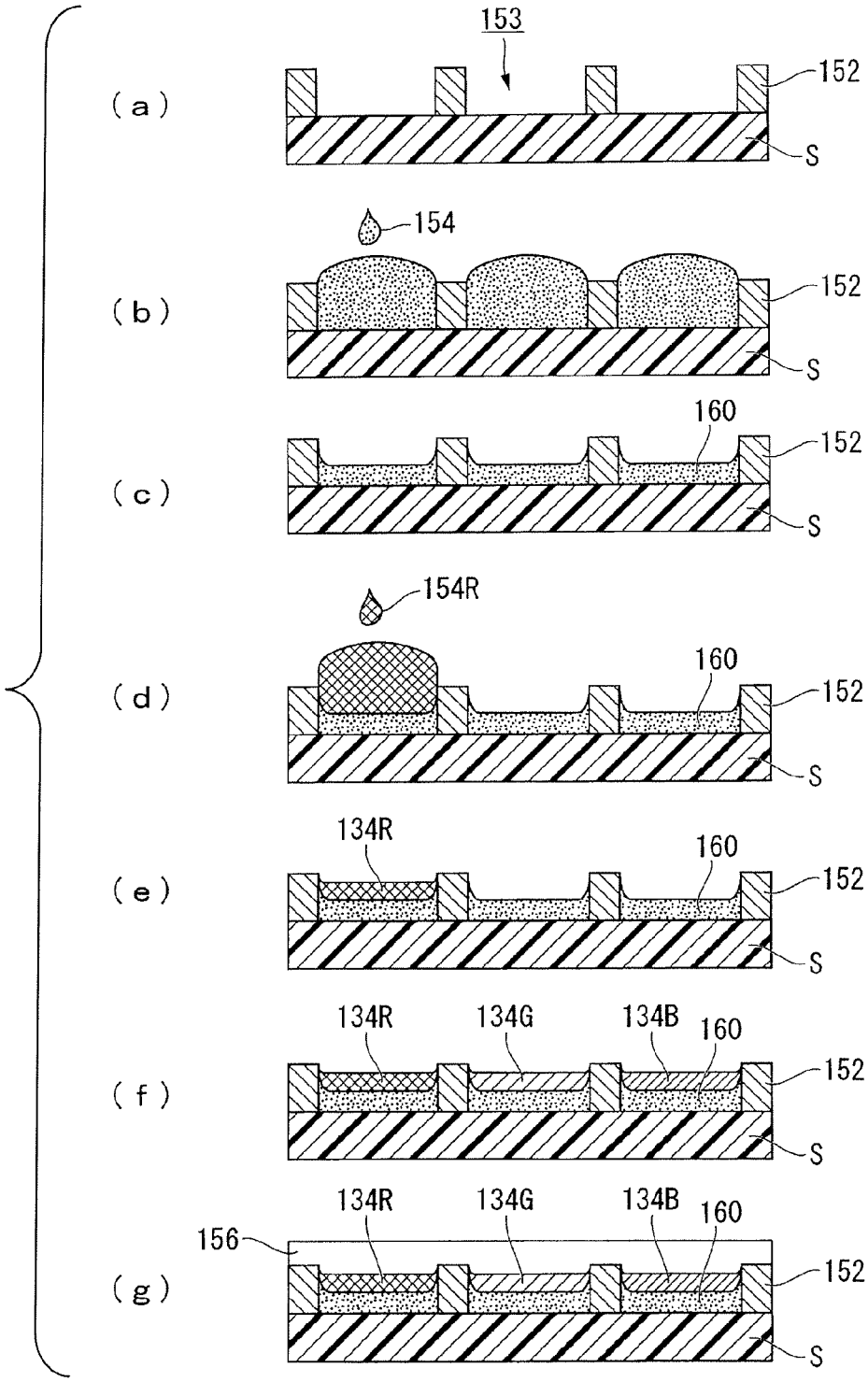
FIG. 14 is an explanatory drawing of a method for manufacturing color filters.

FIG. 14 is an explanatory drawing of the method for manufacturing color filters. To form this type of color filter areas 151, first a black matrix 152 is formed on one side of a transparent substrate S, as shown in FIG. 14(*a*). When the black matrix 152 is formed, an optically nontransparent resin (preferably a black-colored resin) is applied in a predetermined thickness (e.g., about 2 μm) by spin coating or another method, and is patterned using photolithography. The smallest possible display element, i.e., a filter element 153 enclosed in the grid of the black matrix 152, has a width in the X-axis direction of 30 μm and a length in the Y-axis direction of 100 μm, for example. This black matrix has sufficient height and functions as a dividing wall during ink discharge.

Next, ink droplets 154 (liquid) containing a resin composition as an ink-receiving layer are discharged from the droplet discharge heads in the droplet discharge apparatus 1 of the present embodiment as shown in FIG. 14(*b*), and are deposited on the substrate S. The ink droplets 154 are discharged in an amount sufficient to reduce the volume of ink during the heating step. Next, the ink droplets are fused to form an ink-receiving layer 160 as shown in FIG. 14(*c*).

Next, R ink droplets 154R are discharged from the liquid droplet discharge heads 72 as shown in FIG. 14(*d*), and are deposited on the substrate S. The amount of ink droplets 154 discharged is sufficient to reduce the volume of ink during the heating step. Next, the ink is provisionally fused to form an R-colored layer 134R, as shown in FIG. 14(*e*). The step described above is repeated in a G-colored layer formation device and a B-colored layer formation device, and a G-colored layer 134G and a B-colored layer 134B are sequentially formed as shown in FIG. 14(*f*). The R-colored layer 134R, the G-colored layer 134G, and the B-colored layer 134B are fused together after being formed.

Next, an overcoat film (protective film) 156 for covering the colored layers 134R, 134G, and 134B and the black matrix 152 is formed in order to smooth out the substrate S and protect the colored layers 134R, 134G, and 134B, as shown in FIG. 14(*g*). Spin coating, roll coating, ripping, or another method can be used to form the overcoat film 156, and the droplet discharge apparatus 1 can be used in the same manner as with the colored layers 134R, 134G, and 134B.

Liquid Crystal Device

Figure 15:
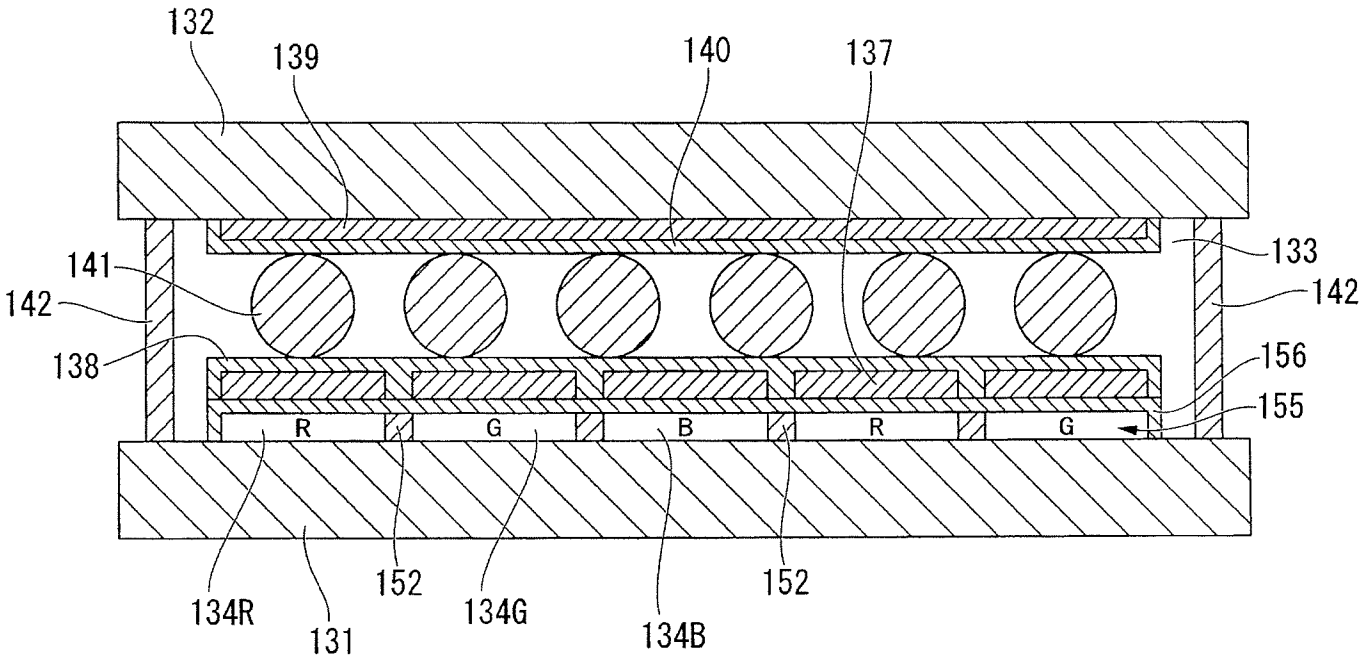
FIG. 15 is a lateral cross-sectional view of a passive-matrix liquid crystal device.

Next, an embodiment of a liquid crystal device (electro-optical device) comprising the color filter described above will be presented. FIG. 15 is a lateral cross-sectional view of a passive-matrix liquid crystal device, and the numerical symbol 130 in FIG. 15 denotes a liquid crystal device. The liquid crystal device 130 is a transparent device in which a liquid crystal layer 133 composed of STN (Super Twisted Nematic) liquid crystal or the like is held between a pair of glass substrates 131, 132.

The aforementioned color filter 155 is formed on the inside surface of one of the glass substrates, 131. The color filter 155 is obtained by arranging the colored layers 134R, 134G, and 134B composed of the colors R, G, and B in a regular pattern. The black matrix 152 is formed between these colored layers 134R (134G, 134B). In order to eliminate and smooth out the difference in grade formed by the color filter 155 and the black matrix 152, the overcoat film (protective film) 156 is formed over the color filter 155 and the black matrix 152. A plurality of electrodes 137 is formed in a striped configuration on the overcoat film 156, and an orientation film 138 is formed over the electrodes.

A plurality of electrodes 139 is formed on the inside surface of the other glass substrate 132 in a striped configuration orthogonally to the electrodes 137 on the side facing the color filter 155, and an orientation film 140 is formed over these electrodes 139. The colored layers 134R, 134G, and 134B of the color filter 155 are disposed at positions orthogonal to the electrodes 139, 137 on the respective glass substrates 132. The electrodes 137, 139 are formed from ITO (Indium Tin Oxide) or another transparent electroconductive material. Furthermore, polarizing plates (not shown) are provided on the outside surfaces of the glass substrate 132 and the color filter 155; and spacers 141 for maintaining a fixed interval (cell gap) between the glass substrates 131, 132 are provided between the substrates 131, 132. Furthermore, a sealant 142 for sealing in the liquid crystal 133 is provided between the glass substrates 131, 132.

In the liquid crystal device 130 of the present embodiment, the color filter 155 manufactured using the above-described droplet discharge apparatus 1 is used, making it possible to obtain a high-quality color liquid crystal display device at low cost.

Electronic Device

The following is a description of a specific example of an electronic device comprising display means composed of the liquid crystal display device described above.

Figure 16:
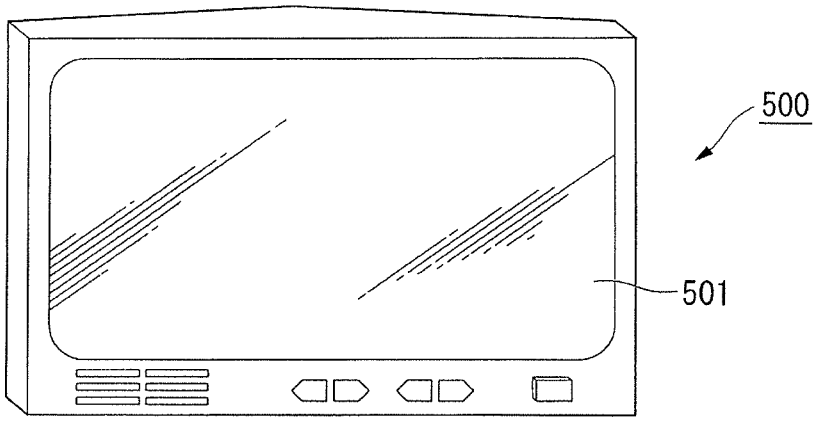
FIG. 16 is a perspective view showing an example of a liquid crystal television.

FIG. 16 is a perspective view showing an example of a liquid crystal television. In FIG. 16, the numerical symbol 500 denotes a liquid crystal television main body, and the numerical symbol 501 denotes a liquid crystal display unit comprising the liquid crystal device of the embodiment described above. Thus, the electronic device shown in FIG. 16 comprises the liquid crystal device of the embodiment described above, and it is therefore possible to obtain an electronic device having a color liquid crystal display with excellent display quality at low cost.

Preferred embodiments according to the present invention were described above with reference to the accompanying drawings, but it is apparent that the present invention is not limited to these examples. The shapes, combinations, and other features of the structural components presented in the foregoing embodiments constitute merely examples, and various modifications can be made based on the design claims and the like within a range that does not deviate from the scope of the present invention.

Figure 17:
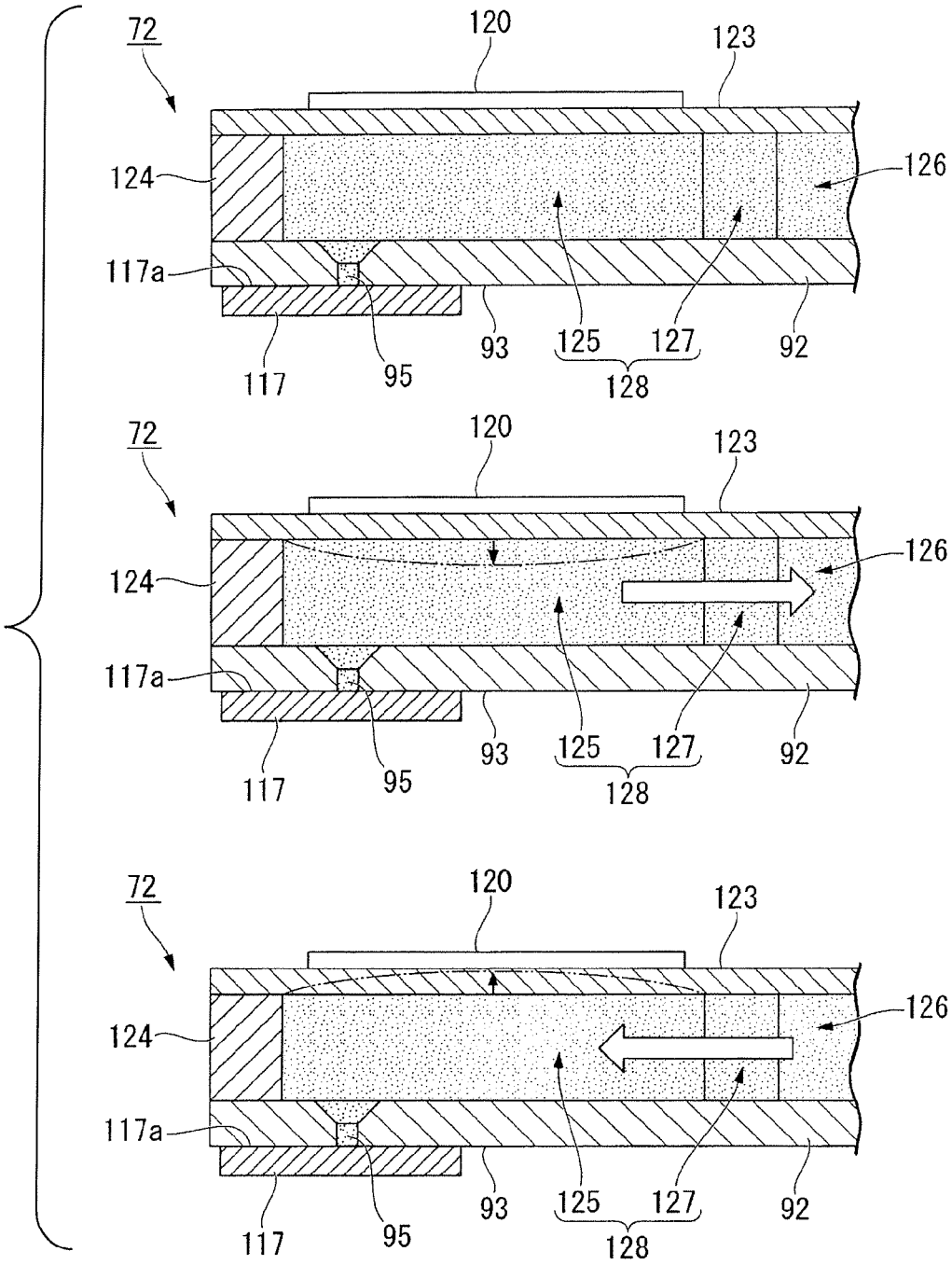
FIG. 17 is a cross-sectional view for describing the process of stirring ink in another embodiment.

For example, the embodiments described above had a configuration in which the piezoelectric elements 120 were driven with a force insufficient to discharge ink from the nozzle openings 95, but the present invention is not limited to this option alone, and may have a configuration in which a nozzle surface blocking device 117 for opening and closing the nozzle openings 95 is provided, and the piezoelectric elements 120 are driven in a state in which the nozzle openings 95 have been closed off by the nozzle surface blocking device 117 as shown in FIG. 17, for example.

The nozzle surface blocking device 117 can have a configuration in which the devices is placed on the workpiece θ-axis table 57; for example, on the +X side of the periodical flushing box 116; the nozzle surface blocking device 117 faces the drawing area 41 when the positioning table 51 faces the workpiece-conveying area 43; the nozzle surface blocking device 117 comes in contact with the nozzle surfaces 93 in the functional liquid droplet discharge heads 72 and closes off the nozzle openings 95 when raised; and the nozzle surface blocking device 117 separates from the nozzle surfaces 93 and opens up the nozzle openings 95 when lowered. In another possible configuration, the device may be provided to the carriage units 31 that move integrally with the functional liquid droplet discharge heads 72. For the material of the nozzle surface blocking device 117, it is preferable to select a strength and hardness that allow the discharge of droplets from the nozzle openings 95 to be reliably suppressed without any damage to the functional liquid droplet discharge heads 72 when the nozzle surface blocking device 117 comes in contact with the nozzle surfaces 93. For example, a resin sheet, a rubber sheet, or the like can be used.

In cases in which the nozzle surface blocking device 117 is provided to the carriage units 31, the ink can be stirred with the functional liquid droplet discharge heads 72 in any position, there is no need to move the functional liquid droplet discharge heads 72 to the position where the nozzle surface blocking device 117 is located, and productivity can be greatly improved.

In the configuration described above, there is no need for the piezoelectric elements 120 to be driven at a force insufficient for ink to be discharged from the nozzle openings 95, allowing the piezoelectric elements 120 to be driven with greater amplitude, the ink in the flow channels 128 to flow in greater amounts and with higher speed, and more efficient stirring to be achieved.

What is claimed is:

1. A method of stirring liquid in a droplet discharge head wherein droplets of the liquid are discharged from a plurality of nozzle openings by driving piezoelectric elements provided to each of the nozzle openings, the method of stirring liquid in a droplet discharge head comprising:

a step of causing the liquid corresponding to the piezoelectric elements to flow at different pressures by varying drive conditions of the piezoelectric elements, wherein the droplet discharge head has:

a plurality of flow channel groups each having a plurality of flow channels that feeds the liquid to the nozzle openings, the flow channels being respectively provided to the nozzle openings; and a liquid reservoir that retains the liquid, the liquid reservoir being connected to each of the flow channels, wherein the piezoelectric elements in each of the flow channel groups are driven in the same direction while the piezoelectric elements in the flow channel groups that are adjacent to each other via the liquid reservoir are driven in mutually opposite directions.

2. The method of stirring liquid in a droplet discharge head according to claim 1, wherein the flow channels are aligned in a plural number on one side of the liquid reservoir along a direction of extension of the liquid reservoir.

3. The method of stirring liquid in a droplet discharge head according to claim 1, wherein the flow channels are disposed on both sides of the liquid reservoir.

4. The method of stirring liquid in a droplet discharge head according to claim 1, wherein the piezoelectric elements corresponding to the flow channel groups that are adjacent to each other via the liquid reservoir are synchronously driven in mutually opposite phases.

5. The method of stirring liquid in a droplet discharge head according to claim 1, wherein the piezoelectric elements are driven in a state in which the nozzle openings are closed off.

6. A droplet discharge apparatus including a droplet discharge head for discharging droplets of a liquid from a plurality of nozzle openings by driving piezoelectric elements provided to each of the nozzle openings, the droplet discharge apparatus comprising:

a drive control device that causes the liquid corresponding to the piezoelectric elements to flow at different pressures by varying drive conditions of the piezoelectric elements, an opening and closing device that opens and closes the nozzle openings, the drive control device driving the piezoelectric elements in a state in which the nozzle openings are closed off, a plurality of flow channels that feeds the liquid to the nozzle openings, the flow channels being respectively provided to the nozzle openings, and a liquid reservoir that retains the liquid, the liquid reservoir being connected to each of the flow channels, wherein the drive control device drives the piezoelectric elements in mutually opposite directions in the flow channels that are adjacent to each other via the liquid reservoir, and the flow channels are disposed on both sides of the liquid reservoir.

7. The droplet discharge apparatus according to claim 6, wherein the piezoelectric elements corresponding to the flow channels that are adjacent to each other via the liquid reservoir are synchronously driven in mutually opposite phases.

8. A droplet discharge apparatus including a droplet discharge head for discharging droplets of a liquid from a plurality of nozzle openings by driving piezoelectric elements provided to each of the nozzle openings, the droplet discharge apparatus comprising:

a drive control device that causes the liquid corresponding to the piezoelectric elements to flow at different pressures by varying drive conditions of the piezoelectric elements, and an opening and closing device that opens and closes the nozzle openings, wherein the drive control device drives the piezoelectric elements in a state in which the nozzle openings are closed off.

9. The droplet discharge apparatus according to claim 8, further comprising a plurality of flow channels that feeds the liquid to the nozzle openings, the flow channels being respectively provided to the nozzle openings, and a liquid reservoir that retains the liquid, the liquid reservoir being connected to each of the flow channels, wherein the drive control device drives the piezoelectric elements in each of a plurality of flow channel groups in the same direction with each of the flow channel groups having a plurality of the flow channels, and drives the piezoelectric elements in the flow channel groups that are adjacent to each other via the liquid reservoir in mutually opposite directions.

10. The droplet discharge apparatus according to claim 9, wherein the piezoelectric elements corresponding to the flow channel groups that are adjacent to each other via the liquid reservoir are synchronously driven in mutually opposite phases.

* * * * *